US009963274B2

(12) United States Patent
Brunner

(10) Patent No.: US 9,963,274 B2
(45) Date of Patent: May 8, 2018

(54) CLOSURE HAVING A LINER AND PULL RING

(71) Applicant: AptarGroup, Inc., Crystal Lake, IL (US)

(72) Inventor: Andrew Brunner, Brookfield, WI (US)

(73) Assignee: APTARGROUP, INC., Crystal Lake, IL (US)

( * ) Notice: Subject to any disclaimer, the term of this patent is extended or adjusted under 35 U.S.C. 154(b) by 469 days.

(21) Appl. No.: 14/428,584

(22) PCT Filed: Nov. 20, 2012

(86) PCT No.: PCT/US2012/066052
§ 371 (c)(1),
(2) Date: Mar. 16, 2015

(87) PCT Pub. No.: WO2014/081413
PCT Pub. Date: May 30, 2014

(65) Prior Publication Data

US 2015/0210441 A1 Jul. 30, 2015

(51) Int. Cl.
*B65D 41/50* (2006.01)
*B65D 51/24* (2006.01)
*B65D 51/20* (2006.01)

(52) U.S. Cl.
CPC ..... *B65D 41/50* (2013.01); *B65D 51/20* (2013.01); *B65D 51/246* (2013.01);
(Continued)

(58) Field of Classification Search
CPC ..... B65D 41/50; B65D 51/20; B65D 51/246; B65D 51/247
(Continued)

(56) References Cited

U.S. PATENT DOCUMENTS 4,815,618 A 3/1989 Gach
4,895,282 A 1/1990 Robinson
(Continued)

FOREIGN PATENT DOCUMENTS

CH 381606 10/1964
CN 201023793 Y 2/2008
(Continued)

OTHER PUBLICATIONS

The "International Search Report and Written Opinion of the International Searching Authority, or the Declaration" dated "Feb. 5, 2013" for the International Application No. PCT/US12/066052 of which the above-captioned instant U.S. patent application Serial No. (not yet designated) is a U.S. national phase application.

*Primary Examiner* — King M Chu
(74) *Attorney, Agent, or Firm* — Wood, Phillips, Katz, Clark & Mortimer

(57) ABSTRACT

A closure (20, 120, 220, 320, 320A, 420) and a method for making a closure (20, 120, 220, 320, 320A, 420) is provided. The closure (20, 120, 220, 320, 320A, 420) is for a container (22) that has an opening to the container interior wherein contents may be stored, and the closure (20, 120, 220, 320, 320A, 420) includes the following: a closure body (30, 130, 230, 430) that is for mounting on the container (22) and that defines an opening through tire closure body (30, 130, 230, 330, 430); a membrane (26, 126, 226, 326, 326A) attached to the closure body (30, 130, 230, 330, 430) and extending across at least a portion of the closure body opening to initially occlude at least a portion of said closure body opening; and a pull ring (36, 136, 236, 336) that is separate from the closure body (30, 130, 230, 330, 430) and that is attached to the membrane (26, 126, 226, 326, 326A) at the closure body opening whereby a user can pull the pull ring (36, 136, 236, 336) to tear at least a portion of the membrane (26, 126, 226, 326, 326A) away from the closure body (30,
(Continued)

130, 230, 330, 430) to provide either access or increased access through the closure body opening.

16 Claims, 44 Drawing Sheets

(52) U.S. Cl.
CPC .... *B65D 51/247* (2013.01); *B65D 2251/0025* (2013.01); *B65D 2251/0093* (2013.01); *Y10T 29/49826* (2015.01)

(58) Field of Classification Search
USPC ..... 202/212; 215/255, 256; 220/270
See application file for complete search history.

(56) References Cited

U.S. PATENT DOCUMENTS

| | | | | |
|---|---|---|---|---|
| 5,009,310 | A * | 4/1991 | Finney | B65D 25/20 206/229 |
| 5,706,974 | A | 1/1998 | Murdick et al. | |
| 5,810,184 | A | 9/1998 | Adams et al. | |
| 6,106,261 | A | 8/2000 | von Holdt | |
| 6,530,493 | B2 | 3/2003 | Anderson | |
| 6,604,645 | B1 | 8/2003 | Vaupotic | |
| 6,604,646 | B2 | 8/2003 | Torniainen et al. | |
| 7,559,432 | B2 * | 7/2009 | Mavin | B65D 47/103 215/256 |
| 7,721,901 | B1 * | 5/2010 | Von Spreckelsen | B65B 3/022 215/232 |
| 7,971,747 | B2 | 7/2011 | Blomdahl et al. | |
| 8,302,805 | B2 | 11/2012 | Blomdahl et al. | |
| 2005/0072816 | A1 * | 4/2005 | von Spreckelsen | B65B 7/285 222/545 |
| 2006/0289376 | A1 * | 12/2006 | Von Spreckelsen | B65D 47/103 215/257 |
| 2007/0267383 | A1 | 11/2007 | McGeough et al. | |
| 2008/0078775 | A1 * | 4/2008 | Steiger | B65D 51/228 220/810 |

FOREIGN PATENT DOCUMENTS

| | | | |
|---|---|---|---|
| EP | 1547934 | A1 | 6/2005 |
| FR | 2747107 | | 10/1997 |
| GB | WO9961337 | | 12/1999 |
| GB | 2399814 | B | 9/2007 |
| GB | 2475872 | A | 6/2011 |
| WO | WO9507847 | | 3/1995 |
| WO | WO2008024775 | A1 | 2/2008 |
| WO | WO2011067585 | | 6/2011 |

* cited by examiner

CLOSURE HAVING A LINER AND PULL RING

TECHNICAL FIELD

This invention relates to container closures. The invention is more particularly related to a closure for use with a container wherein a tearable membrane (e.g., thermoplastic coated foil liner) is interposed between the container and a portion of the closure.

BACKGROUND OF THE INVENTION AND TECHNICAL PROBLEMS POSED BY THE PRIOR ART

Various contents, including baby formula, food items, granules, liquids, creams, powders, small articles, etc., may be conventionally packaged in a container having a closure that can be opened. The container with the closure mounted thereon and the contents stored therein may be characterized as a "package."

The inventor of the present invention has discovered a novel structure for a container closure, and has also discovered a novel method for making the closure wherein the closure includes advantageous features not heretofore taught or contemplated by the prior art.

SUMMARY OF THE INVENTION

According to the present invention, a closure is provided for a container that has an opening to the container interior wherein contents may be stored. A tearable membrane (e.g., "liner") is initially provided as part of the closure so that the membrane can be located to extend across at least a portion of the container opening when the closure is mounted on the container. The membrane is preferably initially secured by thermal bonding (i.e., heat sealing or plastic welding) in, and as part of, the closure, and the membrane is also preferably subsequently secured by thermal bonding to a container to provide a hermetic seal initially over the entire opening of the container. However, in some applications, a hermetic seal of the membrane to the container (by thermal bonding or otherwise) may not be required or desirable, and the closure may also be designed to be completely removable from the container. Depending upon the application, the closure may also include a lid.

More specifically, according to the broad aspects of one form of the invention, the closure includes a closure body for mounting on a container that has an opening to the container interior wherein contents may be stored. The closure body defines an opening through the closure body. A membrane is attached to the closure body and extends across at least a portion of the closure body opening.

In one preferred form of the invention, the membrane is imperforate and extends across the entire closure body opening to initially occlude the closure body opening.

In another form of the invention, the membrane need not extend completely across the closure body opening, and, for example, the membrane may define one or more small orifices that extend through the membrane and that are initially occluded by an auxiliary structure that (1) is attached to one side of the membrane over the small orifice or orifices, and (2) can be subsequently opened.

In either form of the invention, a pull ring is provided separately from the closure body and is attached to the membrane at the closure body opening. A user can pull the pull ring to tear at least a portion of the membrane away from the closure body to provide either access, or increased access, through the closure body opening.

The inventive closure permits the user to conveniently and easily open the membrane. To this end, the closure pull ring that is attached to the membrane has (a) a reduced pull force, and (b) a consistent pull force (i.e., substantially the same pull force from package to package).

A feature of the invention is that the pull ring is molded separately from the closure body and is separately attached to the membrane. The novel closure structure accommodates the molding of the closure body from thermoplastic material while (a) avoiding the prior art problem of trying to force the molten plastic through small frangible bridges to form a pull ring unitary with the closure body, and (b) avoiding, or at least minimizing, the creation of molded plastic knit lines in the pull ring.

If the various components of the closure (e.g., closure body and pull ring (and optional utensil, if employed)) are attached to the membrane by adhesive instead of thermal bonding, then there is no need to have a metallic layer in the membrane for generating thermal bonding heat by an electric field.

In some applications, the membrane need not be hermetically sealed to the top of the container (e.g., if air ingress can be tolerated). In such a case, the membrane, (although either adhesively sealed or thermally bonded (i.e., heat-sealed), to and across the inside of the overlying closure body), can be merely clamped against the top of the container by the closure body using a snap-fit attachment of the closure body to the container. However, if removability of the closure, per se, is desirable, then the closure body could be merely screwed on to the container or bayonet-mounted to the container.

The molding of the pull ring and the optional utensil each as a separate component not unitary with the closure body permits the pull ring and utensil to be positioned on the membrane in an optional, overlapping relationship for a compact arrangement. Such an overlapping relationship of the pull ring and utensil would not be possible if the pull ring and utensil are molded together as a unitary part of the closure body.

Molding the pull ring and optional utensil each separately from the closure body also permits the utensil to be attached to the underside of the membrane in an alternate embodiment—something not possible if the pull ring and utensil are molded together unitary with the closure body. Attachment of the utensil to the underside of the membrane can reduce the overall height of the closure because the utensil will then be located in the head space over the product in the container. Such a reduction of closure height may be desirable in some applications.

By molding the pull ring separately, and not as a unitary part of the closure body with frangible bridge attachments, the magnitude of the pull force required to remove the pull ring, and the variability of the required pull force, is much reduced unit-to-unit. This provides a better repeatability of the opening process unit-to-unit. This provides a more consistent manufactured article unit-to-unit.

Molding the pull ring separately from the closure body eliminates the need for frangible bridges, and thus the user does not ever encounter broken stubs of frangible bridges which are employed in prior art closures and which might cause scratching or discomfort.

Further, molding the pull ring separately from the closure body to eliminate the need for frangible bridges necessarily eliminates the potential problems that can arise with prior art closures when molding a pull ring through a small volume of frangible bridges, and this eliminates or minimizes the flow knit lines that can occur as a result of the molten plastic having to flow through small volume frangible bridges.

Molding the pull ring (and optional utensil) separately permits a different color thermoplastic material to be used for the pull ring (and/or utensil) compared to the closure body.

Molding the pull ring (and optional utensil) separately from the closure body allows the mold for the closure to be greatly simplified, and that can result in a less costly mold for the closure body. The cost reduction can be greater than the added cost required for a separate mold for the pull ring (and optional utensil).

The closure inhibits tampering with the package, and provides evidence of tampering if the membrane has been breached before the intended first user receives the package. The closure does not necessarily require a lid or overcap on the closure body over the membrane (e.g., where the closure is part of a "one-time use" package.

The closure can be provided with a design that accommodates efficient, high quality, large volume manufacturing techniques with a reduced product reject rate.

In accordance with the present invention, a method of making a closure for a container that has an opening comprises the step of providing a closure body for mounting on the container, with the closure body defining an opening through the closure body. The present method further contemplates providing a membrane, and providing a pull ring that is separate from the closure body.

In accordance with the present method, the membrane is attached to the closure body so that the membrane extends across at least a portion of the closure body opening. The present method further entails attaching the pull ring to the membrane at the closure body opening, whereby a user can pull the pull ring to tear a portion of the membrane away from the closure body, to thereby provide access or increased access through the closure body opening.

In one disclosed method for practicing the present invention, the step of attaching the membrane to the closure body is performed prior to the step of attaching the pull ring to the membrane. In accordance with the illustrated embodiment, the closure includes the lid having an internal, resilient spud, with the step of attaching the pull ring to the membrane including engaging the spud with the pull ring.

In an alternate method of practice of the present invention, the step of attaching the pull ring to the membrane is performed prior to the step of attaching the membrane to the closure body. In this aspect of the present invention, the pull ring is attached to a web from which the membrane is formed, with the membrane cut from the web with the pull ring attached to the membrane. The membrane with the pull ring attached thereto is thereafter attached to the closure body so that the membrane extends across at least a portion of the closure body opening.

The closure can optionally be designed to accommodate its use with a variety of conventional or special containers having a variety of conventional or special container finishes, including conventional threaded, or snap-fit, attachment configurations. Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

FIG. 12 shows how such individual membranes are defined on the web, and how each membrane receives a pull ring attached thereto, and how each assembly of the pull ring and membrane is subsequently separated from the web;

FIG. 13 shows a portion of the membrane broken away to illustrate details of the closure above the membrane, and FIG. 13 also shows the closure with the lid closed in a configuration that the closure would have prior to installation on a container;

FIG. 15 is an isometric view of the underside of the closure with the lid open and with a portion of the membrane broken away to better illustrated interior detail, and FIG. 15 shows the attachment of a utensil in the form of a food item spear attached to the bottom surface of the membrane;

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, many of the figures illustrating the invention show the embodiments of the closure as including a separate, closure in the typical orientations that the closure would have at the top of a container when the container is stored upright on its base, and terms such as upper, lower, horizontal, etc., are used with reference to this position. It will be understood, however, that the closure of this invention may be manufactured, stored, transported, used, and sold in an orientation other than the orientations described.

The closure of this invention is suitable for use with a variety of conventional or special containers, the details of which, although not fully illustrated or described, would be apparent to those having skill in the art and an understanding of such containers. The particular container, per se, that is illustrated and described herein forms no part of, and therefore is not intended to limit, the present invention. It will also be understood by those of ordinary skill that novel and non-obvious inventive aspects are embodied in the described exemplary closure alone.

Figure 1:
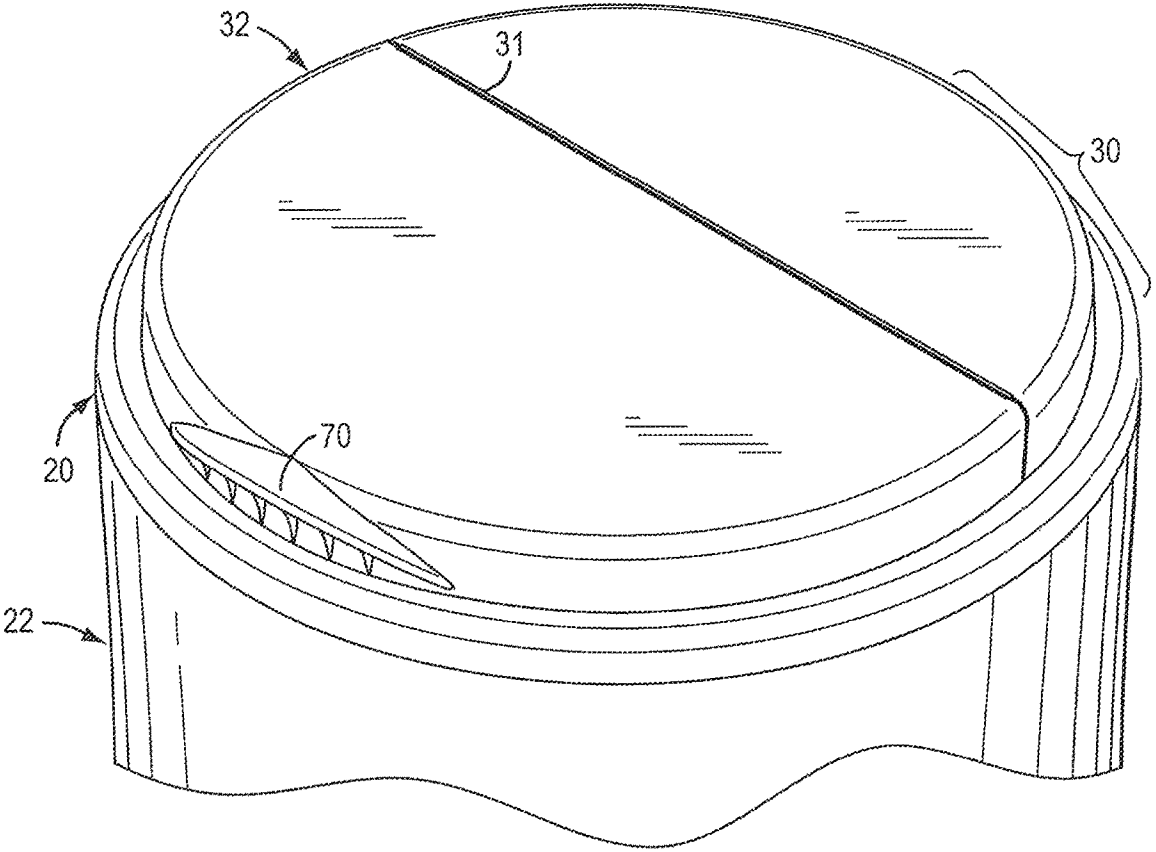
FIG. 1 is a fragmentary, isometric view of a first embodiment of the closure of the present invention in the form of a separate dispensing closure according to a preferred form of the invention, and the closure is shown installed on a container with the closure lid closed.
Figure 2:
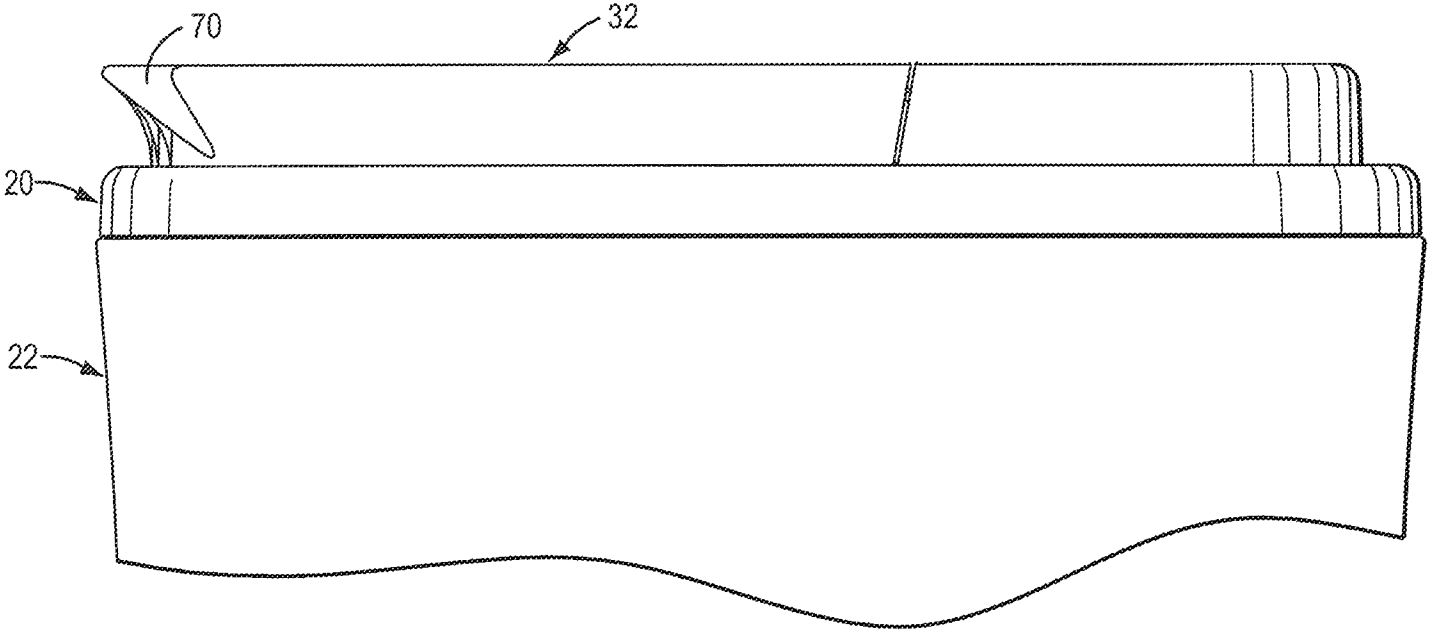
FIG. 2 is a fragmentary, side elevational view of the components shown in FIG. 1.
Figure 3:
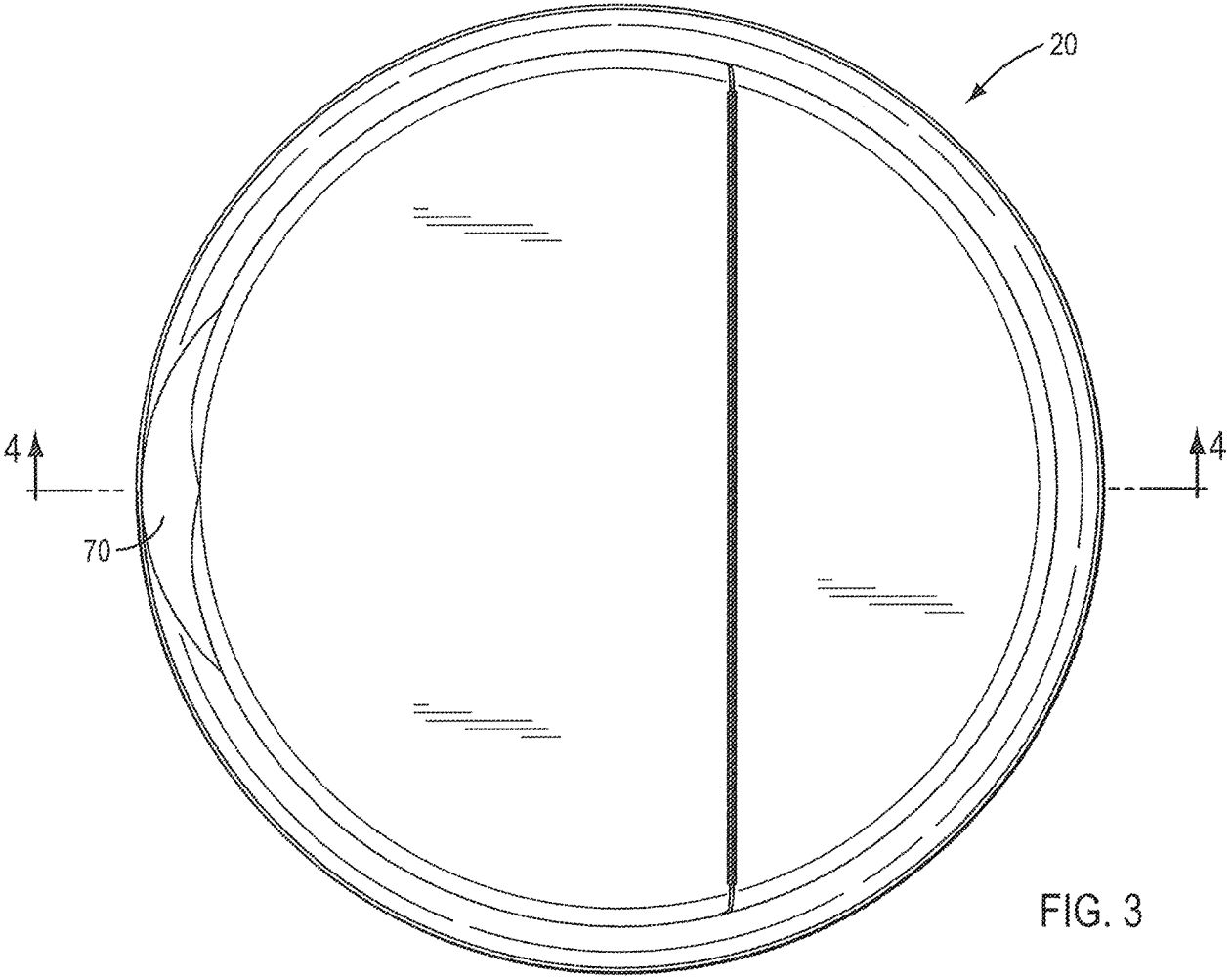
FIG. 3 is a top, plan view of the closed closure shown in FIG. 1.
Figure 4:
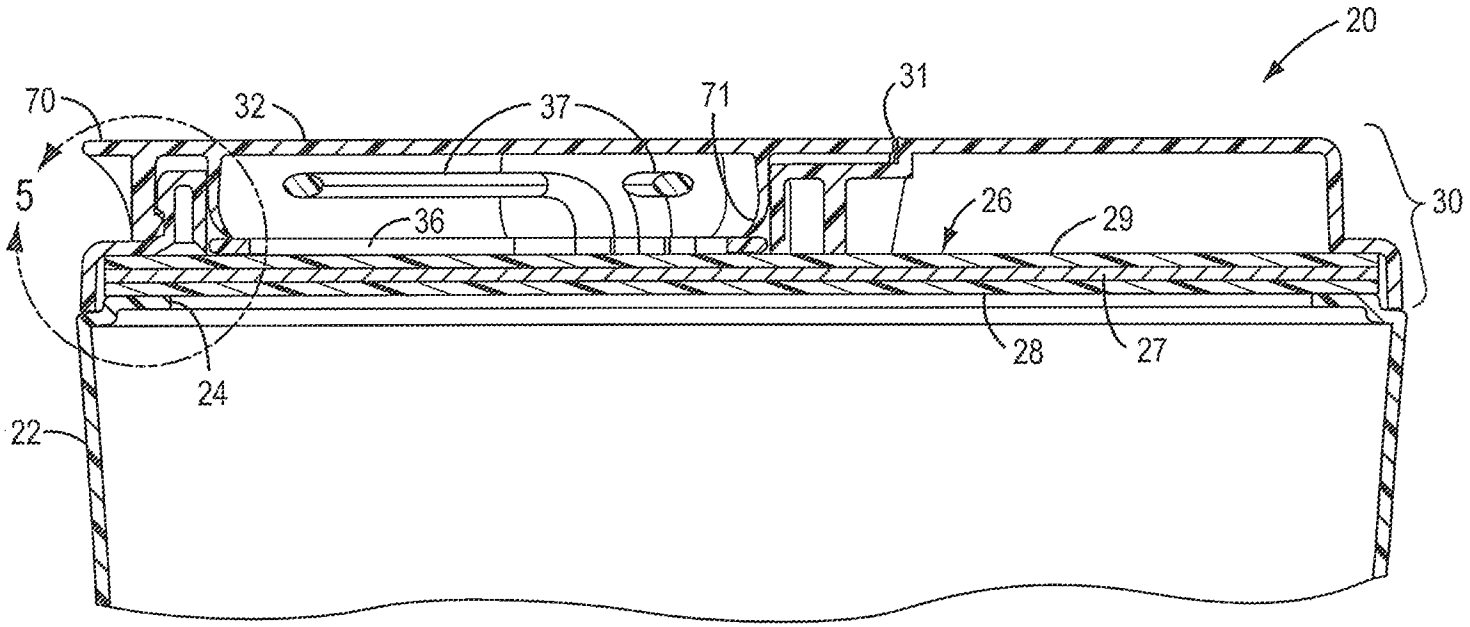
FIG. 4 is a cross-sectional view taken generally along the plane 4-4 in FIG. 3.
Figure 13:
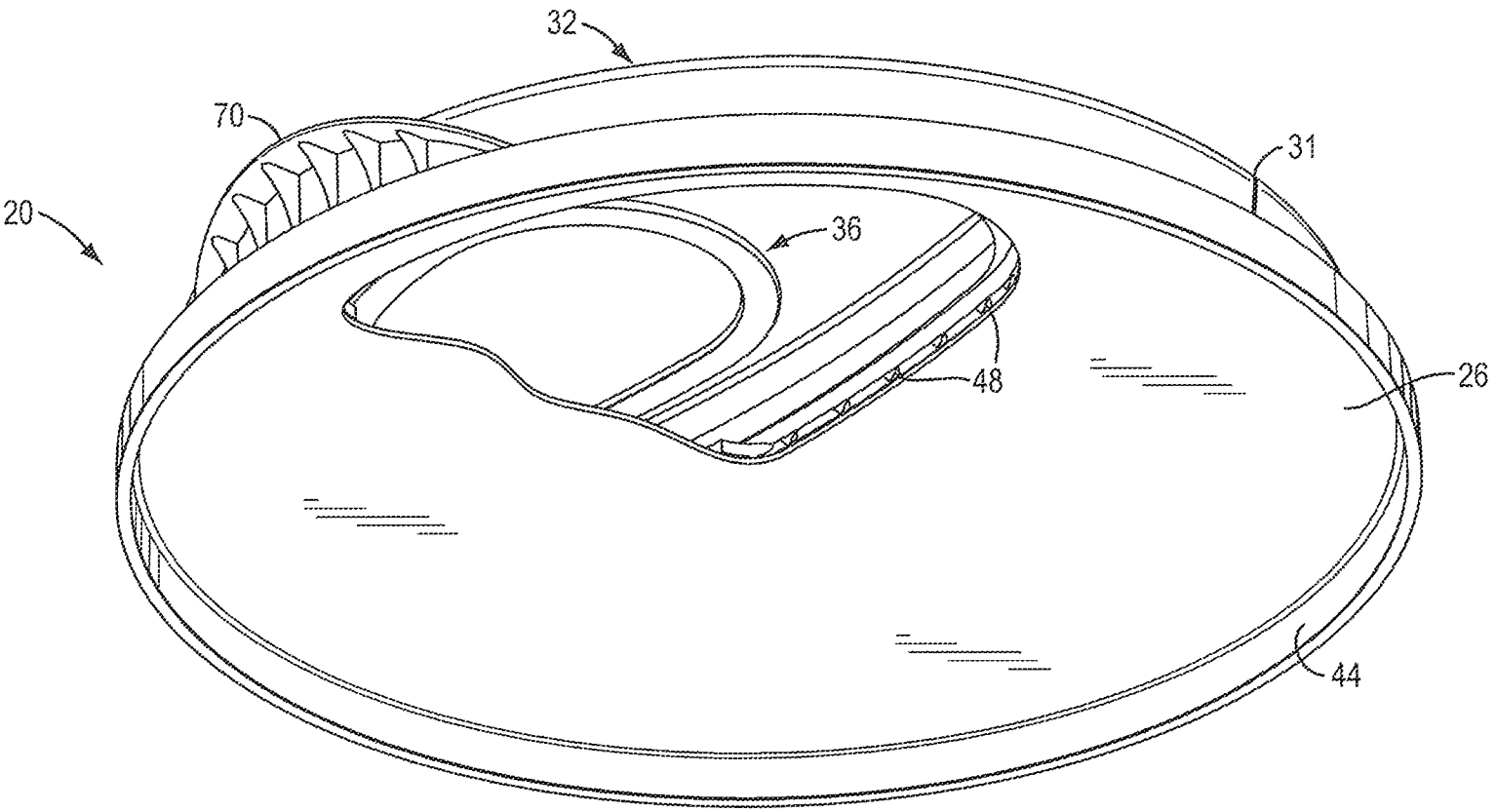
FIG. 13 is an isometric view of the closure as viewed from underneath the closure prior to installation of the closure on a container.

A first embodiment of a closure of the present invention is illustrated in FIG. 13 and is designated generally therein by reference number 20 in FIG. 1. In the first embodiment illustrated, the closure 20 is provided in the form of a separate closure 20 which is adapted to be mounted or installed on a container 22 that would typically contain contents such as a product or products consisting of articles or fluent material. The container 22 includes a portion extending upwardly to define an opening 24 (FIG. 4) to the container interior. The first embodiment of the closure 20 is particularly suitable for use with a container 22 that is formed from polyethylene.

Figure 6:
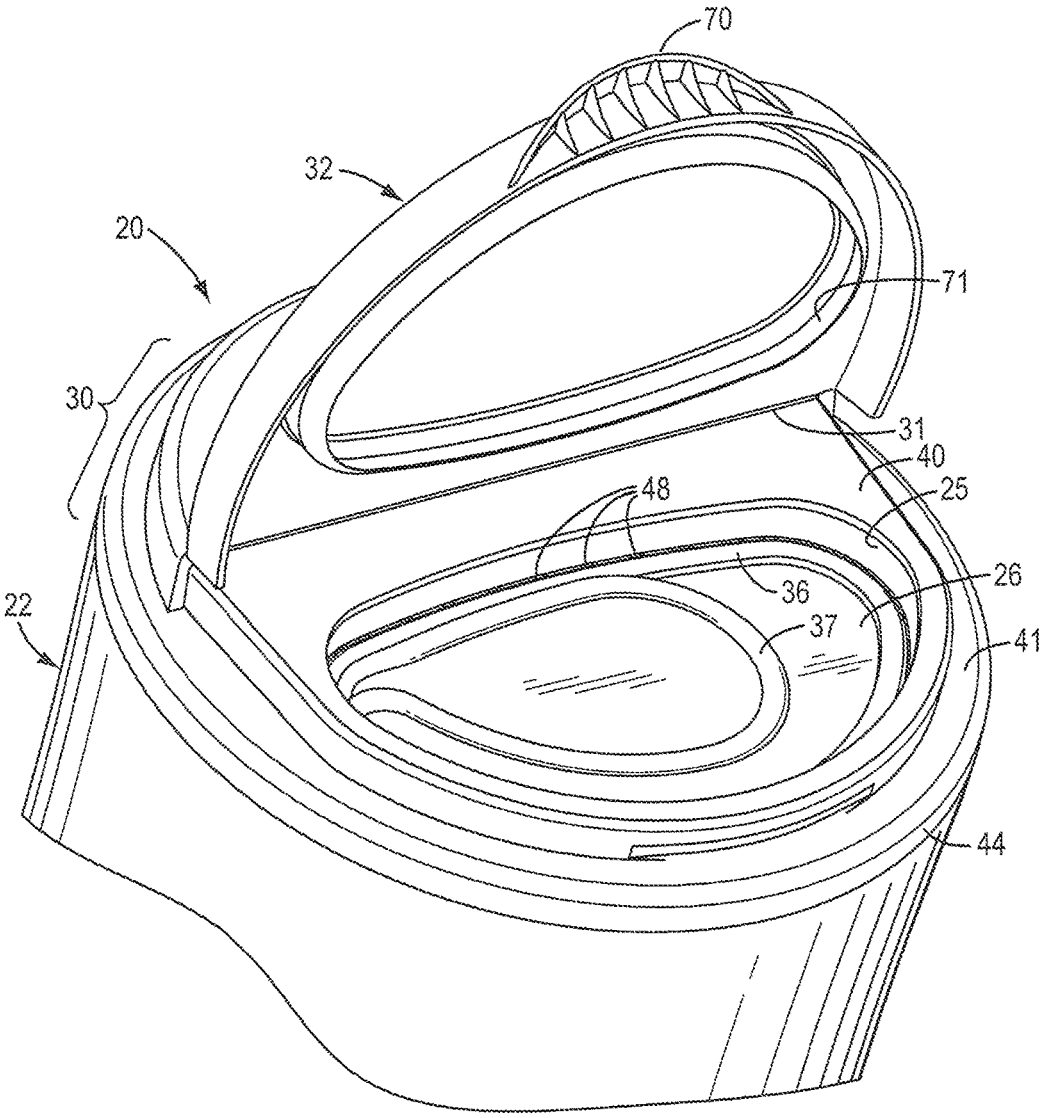
FIG. 6 is an isometric view of the closure with the lid open.
Figure 7:
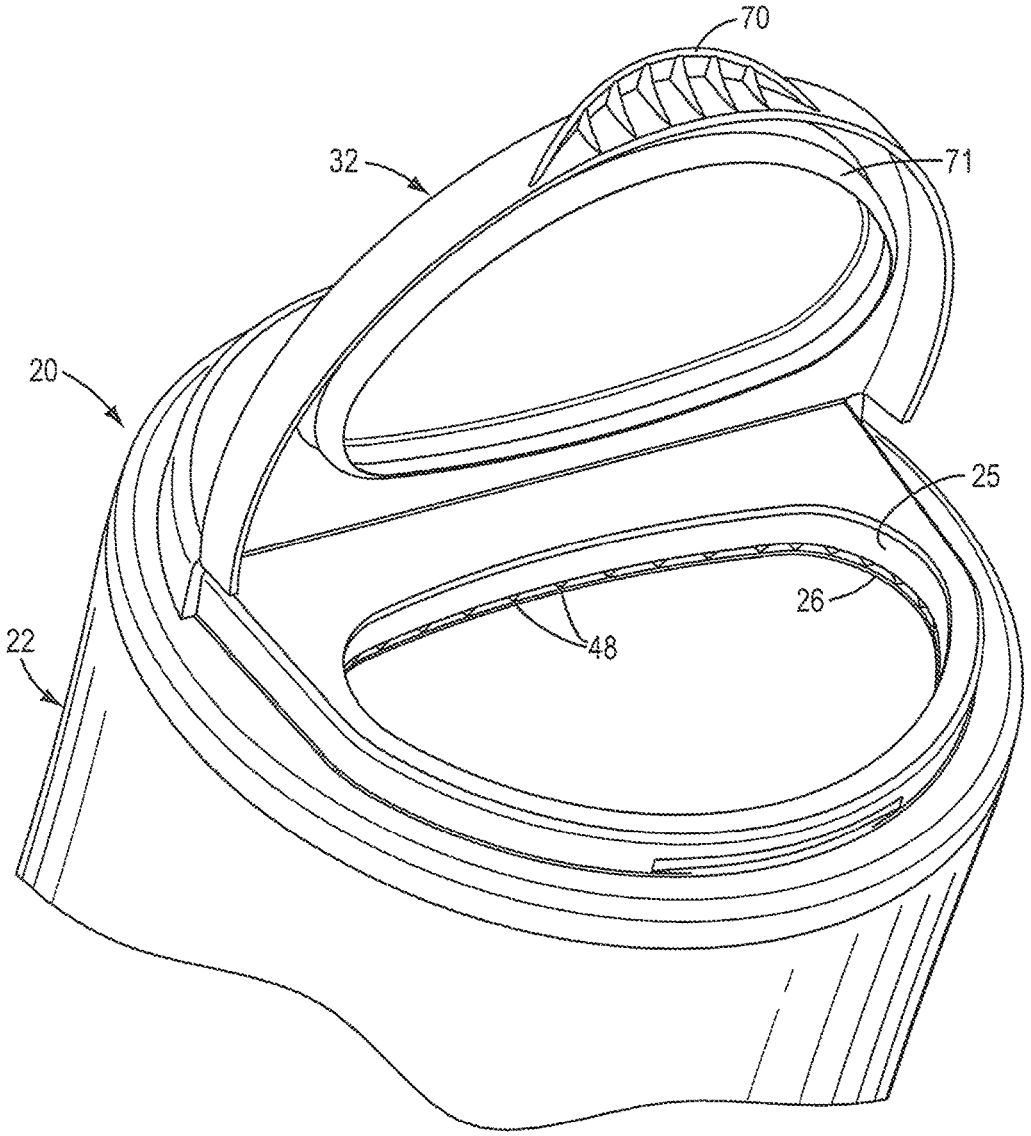
FIG. 7 is an isometric view like FIG. 6, but FIG. 7 shows the closure after the pull ring and portion of the foil liner have been torn away to provide access to the container interior.
Figure 8:
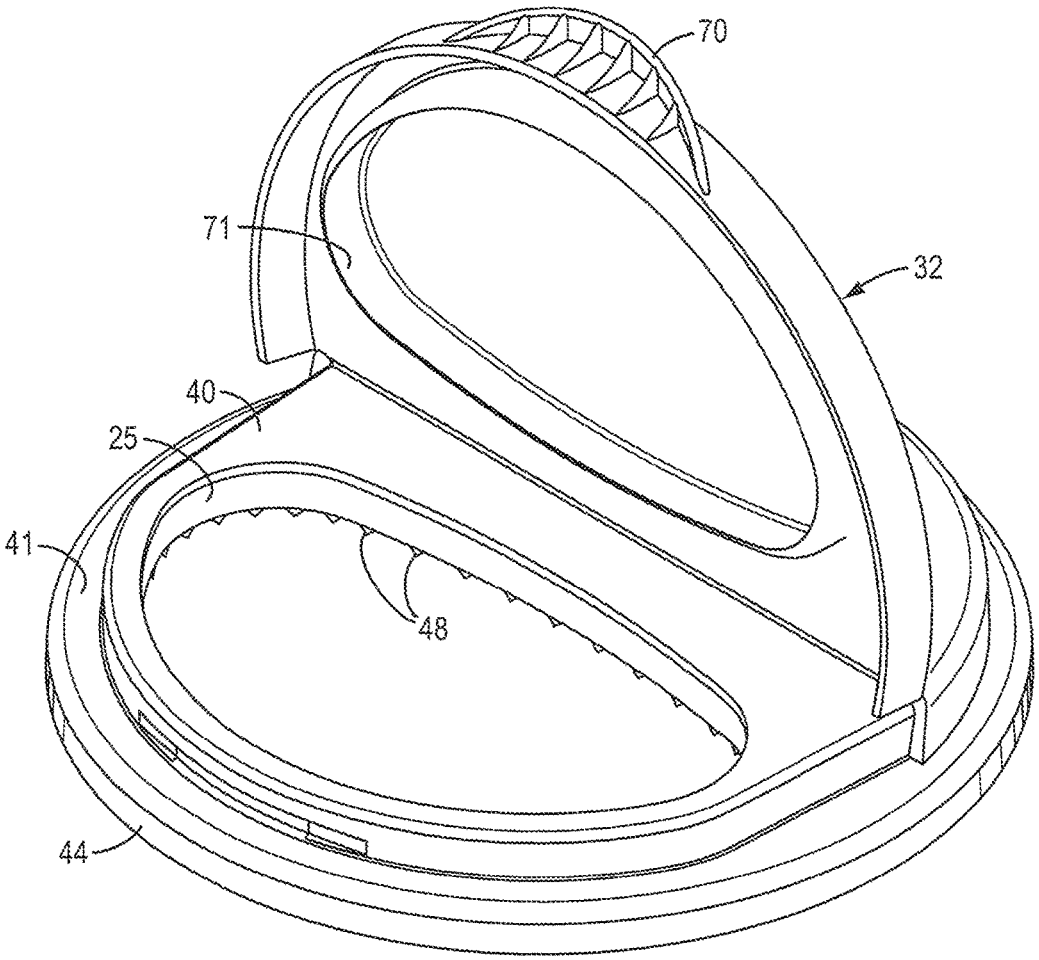
FIG. 8 is an isometric view of the closure alone in the as-molded condition as viewed from above with the lid open and prior to closing the lid, and prior to installing the foil liner and pull ring.
Figure 9:
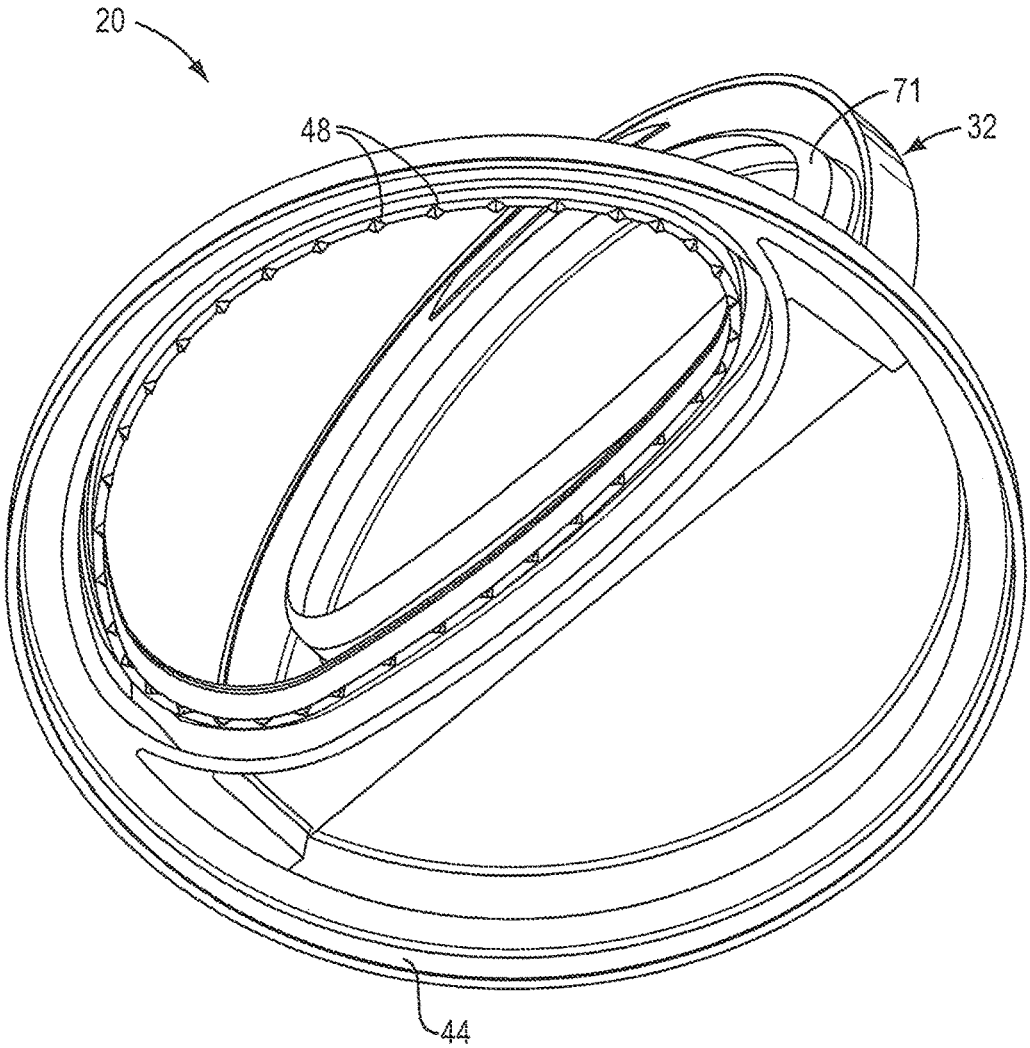
FIG. 9 is an isometric view of the as-molded closure in FIG. 8, but FIG. 9 shows the closure from the bottom.
Figure 10:
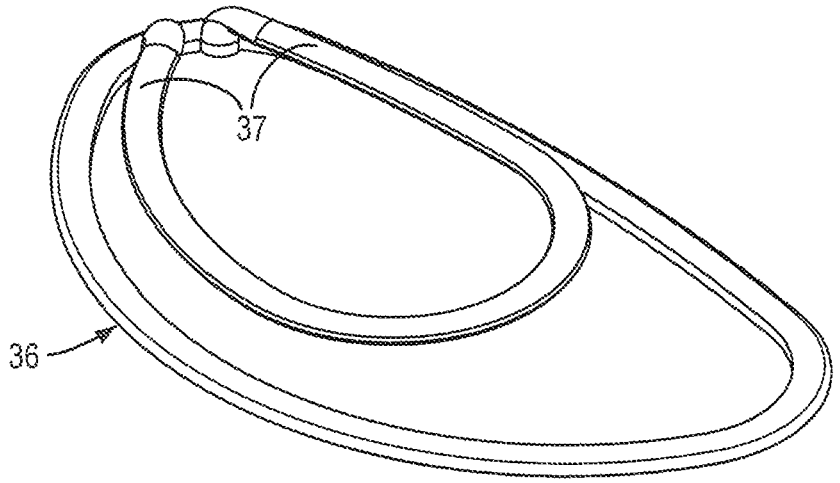
FIG. 10 is a fragmentary, isometric view of the pull ring alone in the as-molded condition as viewed from above.

A membrane 26 in the form of a tamper-evident foil liner 26 is disposed within the closure 20 to be located across the top of the container over the opening 24. Hereinafter the terms "membrane" and "liner" will be used interchangeably. FIG. 6 shows the liner 26 before part of it has been torn away, and FIG. 7 shows the opened closure 20 after a user has torn away a part of the liner coextensive with an access orifice or opening defined in the closure 20 by a surrounding orifice wall 25.

The membrane 26 may be of any special or conventional type. In the preferred embodiment illustrated in FIG. 5, the membrane 26 is a commercially available foil liner sold under the trade designation "LAMINATE 150MDPE/0.001/100CPP" by Coflex Packaging having an office at 1970 John-Yule Street, Chambly, Quebec, J3L 6W3, Canada (Website: www.deluxepaper_com). This liner 26 consists of a layer of 25 micron thick aluminum foil 27 bonded with adhesive to a top layer of 25 micron thick cast polypropylene 29 and bonded with adhesive to a bottom layer of 38 micron thick medium density polyethylene 28. The liner 26 has a total thickness of about 94 microns and has a total basis weight of about 132 grams per square meter. The particular composition and structural details of the liner 26 form no part of the broad aspects of the present invention.

In one preferred embodiment form of a package employing the closure of the present invention illustrated in FIGS. 1-13, the liner 26 is initially attached to the closure 20 to portions of the downwardly facing, interior surface or surfaces of the closure 20. The liner 26 is also preferably subsequently attached to the top of the container 22. The particular type of liner 26 described above can be readily attached to the closure 20 by thermally bonding (i.e., heat sealing) the polypropylene top surface to the closure 20 if the closure 20 is molded from polypropylene, and later the bottom polyethylene surface of the liner 26 can be readily thermally bonded to a polyethylene container 22.

The illustrated first embodiment of the closure 20 is adapted to be used with a container 22 having an opening 24 to provide access to the container interior and to a product contained therein (after a portion of the liner 26 is torn away). The closure 20 can be used on containers holding various substances, including, but not limited to, baby formula, powders, liquids, suspensions, mixtures, pieces of solid food, discrete articles, etc. The container 22 may have a flexible wall or walls (or a rigid wall or walls) which can be grasped by the user.

The container 22 may have any suitable configuration. The container 22, per se, does not form a part of the broadest aspects of the present invention, per se. The closure 20 is a completely separate article or unit (e.g., a closure 20) which can comprise multiple pieces, and which is adapted to be removably, or non-removably, installed on a previously manufactured container 22 that has an opening 24 to the container interior.

It is presently contemplated that many applications employing the closure 20 will conveniently be realized by molding a main portion of the closure 20 from suitable thermoplastic material as a unitary structure. However, not all of the portions of the closure are molded together as a unitary structure. In the illustrated first embodiment, at least some of the portions of the closure are molded from a suitable thermoplastic material, such as, but not limited to, polypropylene. The closure portions which are separately molded may be molded from different materials. The materials may have the same or different colors and textures.

As can be seen in FIG. 6, the first embodiment of the closure 20 includes a number of basic components, (1) a unitary molded body 30 and lid 32 connected together with an attached hinge 31, (2) a membrane 26 (such as a foil liner) attached to the closure body 30 (e.g., by thermal bonding or adhesive), and (3) a pull ring 36 attached to the membrane 26 (e.g., by thermal bonding or adhesive). The pull ring 36 includes an offset (elevated) finger pull loop 37.

In some applications, the lid 32 may be omitted altogether. In the preferred form of the first embodiment of the invention, the lid 32 is provided to be closed over, and cover, a portion of the closure body 30. The lid 32 can be moved to expose the upper part of the body 30 (FIG. 6). The lid 32 is movable between (1) a closed position over the body 30 (as shown in FIG. 1), and (2) an open position (as show in FIG. 6). In the illustrated first embodiment, the lid 32 is hinged to the body 30 so as to accommodate pivoting movement of the lid 32 between the closed position and open position. In an alternative design (not illustrated), the lid 32 may be a separate component which is completely removable from the closure body 30, or the lid 32 may be tethered to the body with a strap. In another alternative design (not illustrated), the lid could be omitted altogether.

In a presently preferred form of the first embodiment of the closure 20, the unitary closure body 30 and lid 32 are molded from polypropylene sold under the designation 3727W by Total Petrochemical USA, Inc., 120 Louisiana Street, Suite 1800, Houston Tex. 77002, U.S.A.

Figure 5:
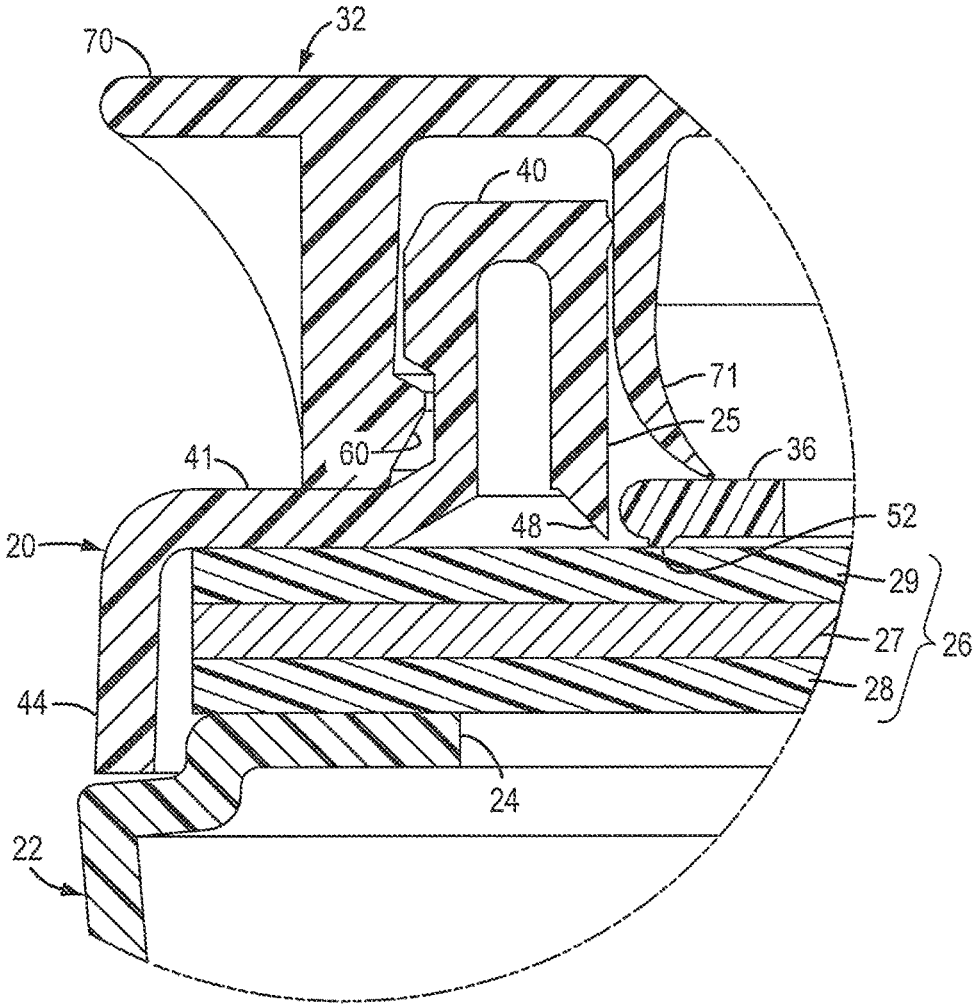
FIG. 5 is a greatly enlarged, fragmentary, cross-sectional view of a portion of the structure enclosed in the circle designated "FIG. 5" in FIG. 4, and in FIG. 5 the thickness of the membrane is exaggerated for ease of illustration and clarity.

As can be seen in FIG. 6, the closure body 30 includes a raised deck 40, peripheral shoulder 41, and a skirt 44. The skirt 44 extends downwardly from the periphery of the deck 40 (as shown in FIG. 5) to surround the liner 26. As can be seen in FIG. 5, the orifice wall 25 extends downwardly from the deck 40 to define the closure body access opening.

The lower edge of the orifice wall 25 defines a plurality of downwardly pointing pyramid shaped teeth 48 (FIGS. 5-9 and 13) which are spaced apart around the opening defined by the orifice wall 25.

As can be seen in FIG. 5, the interior of the closure 20 can be secured to the top of the container, preferably by thermal bonding of the liner 26 to the top of the container 22.

Alternatively, or in addition, the container 22 and closure 20 could be provided with another connecting means, such as a snap-fit bead or groove arrangement (not illustrated). Also, the closure body 20 could instead be attached to the container 22 by means of a bayonet mount or threaded attachment.

The closure body 30 may have any suitable configuration for receiving or otherwise accommodating an upwardly projecting portion of the container 22 or for accommodating any other portion of a container received within the particular configuration of the closure body 30—even if a container does not have a reduced size upper open end. The main part of the container 22 may have a different cross-sectional shape than the upper portion of the container that defines the container opening.

In the illustrated first embodiment, where a lid 32 is provided and where the lid 32 is connected to the closure body 30 with a hinge 31, the hinge 31 may be of any suitable type. One form of a hinge 31 that may advantageously be used is a conventional reduced-thickness living hinge as illustrated. Other types of hinges could be used. In some applications, the hinge could be omitted altogether, and the lid 32 need not be connected as a unitary part of the body 30. In other applications, it may be desirable to omit the lid 32 entirely.

Where a lid, such as the lid 32, is employed as shown in FIG. 5, it may be desirable to provide a conventional latch bead 60 along a portion or portions of the lower edge of the lid 32, and to provide a cooperating conventional latch groove 62 around a portion or portions of the closure body 30 below the deck 40 and above the shoulder 41. When the lid 32 is closed, the lid latch bead 60 overrides the edge of the body deck 40 and establishes a latched engagement in the body latch groove 62. To facilitate opening of the lid 32, the lid 32 includes a finger or thumb lift 68 (FIGS. 1-8).

The lid 32 includes an internal, resilient spud 71 (FIGS. 4-9). In the first embodiment of the closure 20 is illustrated in FIGS. 1-13. The spud 70 seals against the inside surface of the orifice wall 25 when the lid 32 is closed. As shown in FIG. 5, the lower edge of the spud 71 initially also contacts the upper surface of the periphery of the pull ring 36 when the lid 32 is closed.

In some applications, the teeth 48 could be omitted, but the teeth 48 are preferred in many applications. Also, the liner 26 need not be thermally bonded or otherwise attached to the downwardly facing surface of the closure body 30 at the pointed ends of the teeth 48. Rather, in some applications, the liner 26 could be attached to the downwardly facing surface of the closure body 30 at locations spaced some distance laterally outwardly from the orifice wall 25 and teeth 48. However, in the preferred embodiment of the closure 20 shown in FIGS. 1-13, the liner 26 is bonded to the underside of the closure body 30 to provide a hermetic seal that is continuous around the periphery of the closure body opening at or adjacent the teeth 48.

Figure 11:
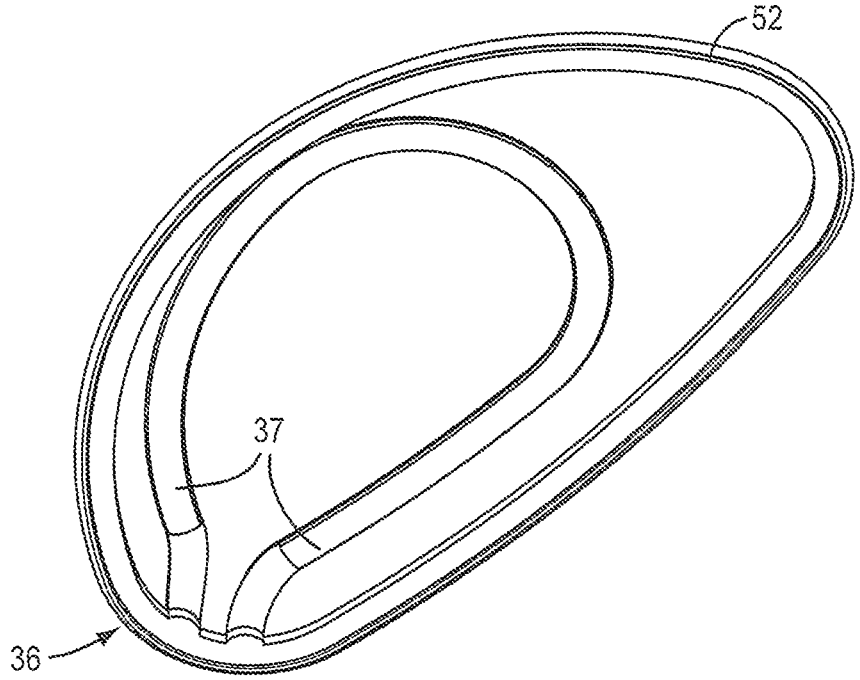
FIG. 11 is an isometric view of the as-molded pull ring in FIG. 10, but FIG. 11 shows the pull ring from the bottom.

The pull ring 36 is preferably attached to the liner 26 over a substantial portion of a path around the interior of the orifice wall 25 and teeth 48. In the first embodiment illustrated in FIGS. 1-13, the pull ring 36 defines a continuous path or loop in contact with, and attached to, the liner 26. As shown in FIGS. 5 and 11, the underside (i.e., bottom surface) of the pull ring 36 defines a downwardly projecting rib 52 which contacts only a small portion of the upwardly facing surface of the membrane 26. In the first embodiment of the closure 20 illustrated in FIGS. 1-13, the pull ring 36 is attached to the membrane 26 along the rib 52. In the preferred embodiment, the pull ring 36 is thermally bonded to the membrane 26, and the rib 52 functions as a "weld concentrator" for facilitating the thermal bonding of the pull ring 36 to the membrane 26.

Figure 12:
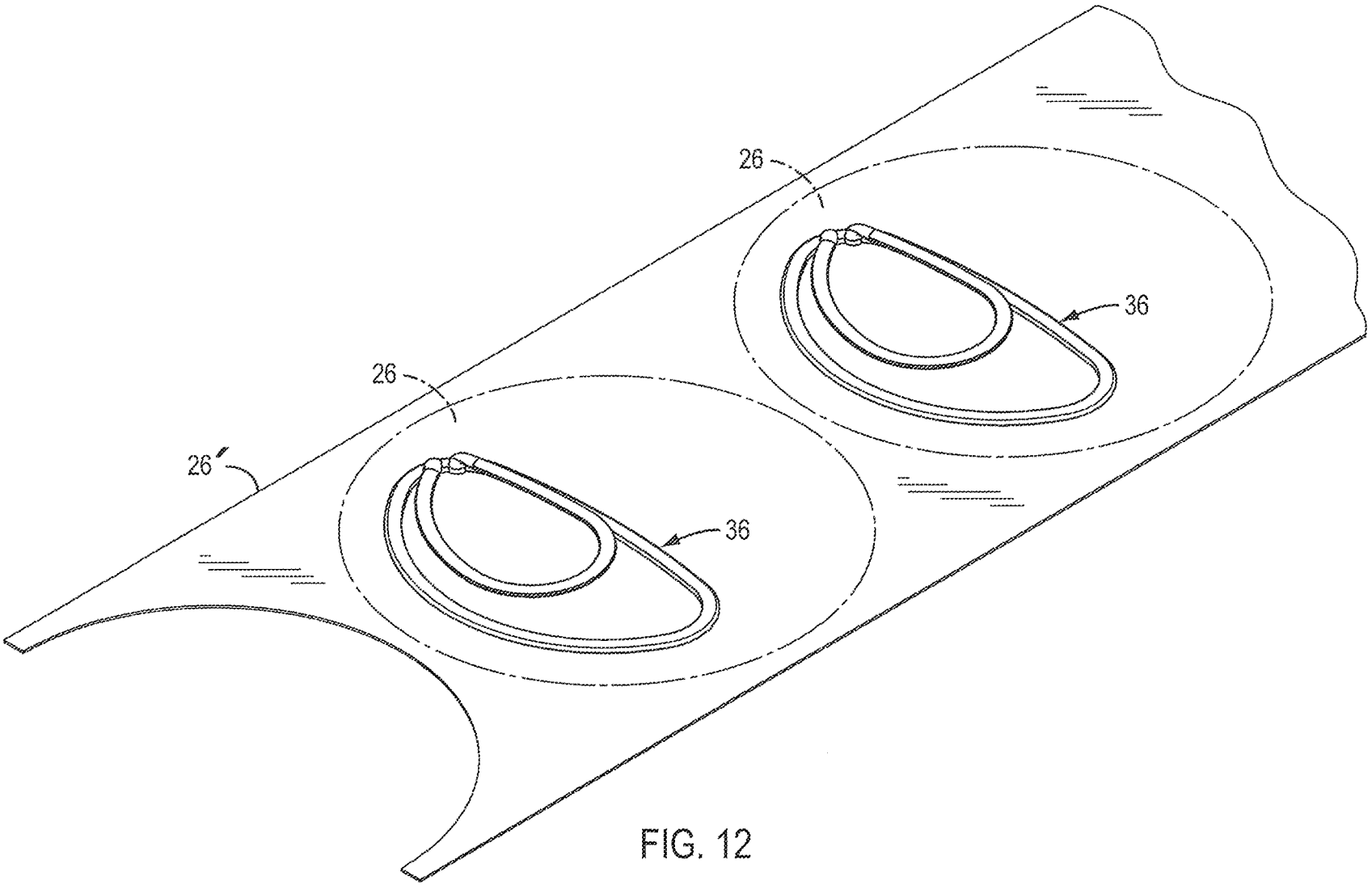
FIG. 12 is a somewhat diagrammatic view of one form of a process or method by which a plurality of pull rings can be positioned and secured to a web strip or web of material from which the closure membrane is defined.

FIG. 12 illustrates one way in which the pull ring 36 is oriented on a membrane 26 on a strip or web of membrane material 26'. Each membrane 26 has a circular configuration which can be stamped or cut from the web material 26' after a pull ring 36 has been molded and adhered to the upper surface of the membrane material 26' in the appropriate orientation. Alternatively, each membrane 26 can be first cut or stamped from a strip or web of the membrane material 26', and a pull ring 36 can be subsequently attached to the top surface of the membrane 26. In preferred methods of making the closure 20, the pull ring 36 and membrane 26 are thermally bonded together, and the membrane 26 is thermally bonded to the closure body 30—the particular method steps for such a thermal bonding process, and variations of such steps, being discussed hereinafter in detail following descriptions of alternate embodiments of the closure 20.

When the closure 20 is initially completed by the manufacturer with the lid 32 in closed condition as shown in FIG. 13, the closure 20 can be provided to a packager, and the packager can install the closure on the container 22 as shown in FIGS. 1-5.

Subsequently, a user who acquires the package can initially open the package by opening the lid 32 (to the configuration illustrated in FIG. 6) so as to provide access to the pull ring 36. The user can then lift up and pull on the finger pull loop 37 to exert a force on the pull ring 36 and on the attached portion of the membrane 26. When the user applies a sufficient force to the pull ring 36, the membrane 26 is torn around the inside periphery of the closure body opening at the lower edge of the wall 25. If the closure 20 includes teeth 48 as in the first embodiment illustrated in FIGS. 1-13, then such teeth 48 assist in the tearing of the membrane 26. The torn away portion of the membrane 26 and the attached pull ring 36 can then be discarded, and the user can remove some or all of the contents from the container 22 through the opening that has been created.

A preferred method or methods of making the first embodiment of the closure 20 illustrated in FIGS. 1-13 are discussed hereinafter following a description of some alternate embodiments of the closure.

Figure 14:
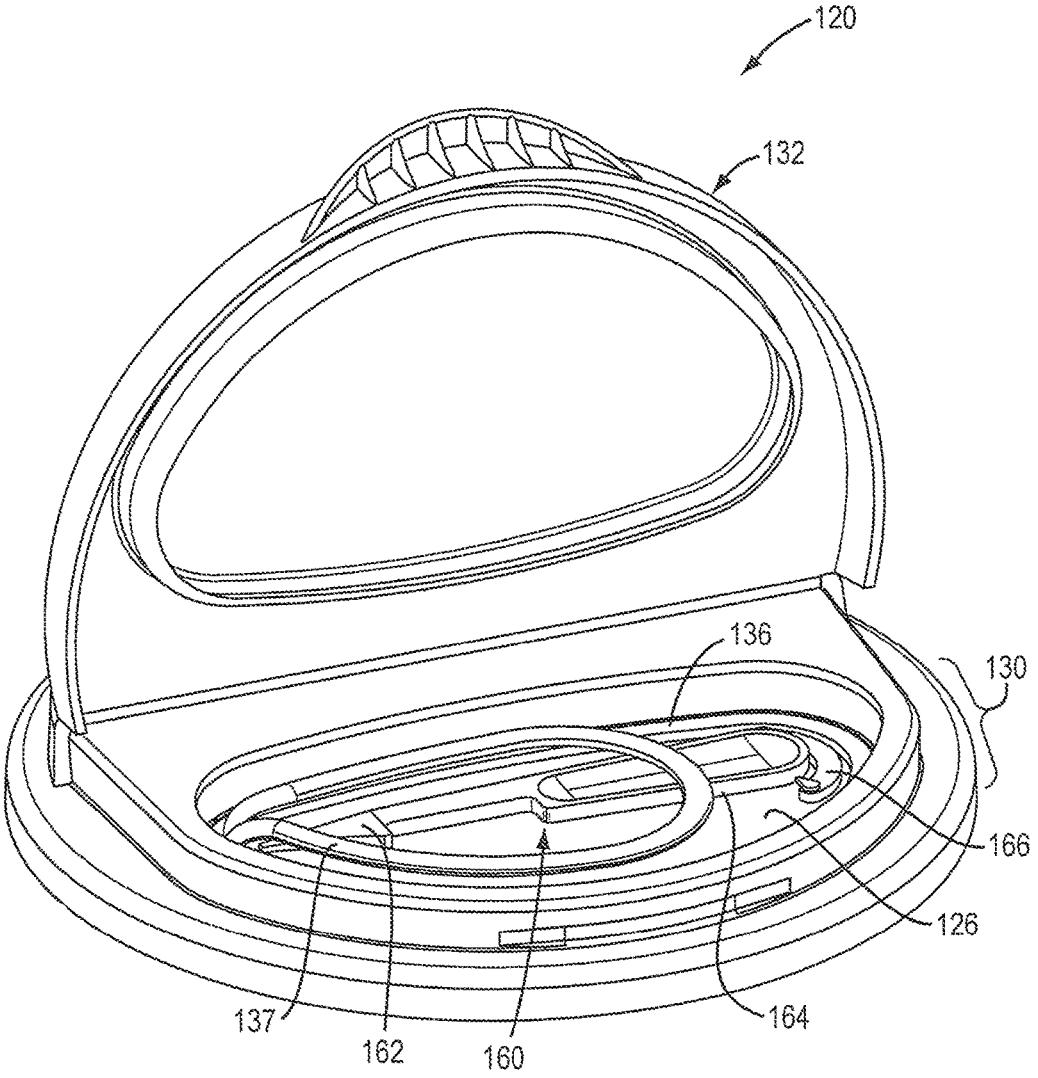
FIG. 14 is an isometric view from above of an alternate embodiment of the closure shown in the as-molded condition with the lid open, and in this alternate embodiment the closure includes a utensil in the form of a food item spear which is attached to the upper surface of the membrane beneath the finger pull loop of the pull ring.

FIG. 14 illustrates an alternate form or embodiment of the closure, and in FIG. 14, the alternate closure is designated generally by the reference number 120. The closure 120 includes a closure body 130 and a hinged lid 132. The closure 120 also includes a membrane 126 to which is attached a pull ring 136 having a finger pull loop 137. The closure body 130, lid 132, pull ring 136, and membrane 126 are identical, or substantially identical, to the analogous components of the first embodiment of the closure 20 described above in detail with reference to FIGS. 1-13.

Also attached to the membrane 126 is a utensil in the form of a food item spear 160. The spear 160 is molded separately from closure body 130, lid 132, and pull ring 136. Typically, the spear 160 would be molded from the same thermoplastic material as the pull ring 136. The spear 160 has a pointed or barbed spear tip 162 and a handle portion 164. The spear tip 162 and part of the handle portion 164 extend under, and are overlapped by, the finger pull loop 137. The handle portion 164 of the spear 160 includes an outwardly extending attachment portion 166 which is attached to the membrane 126. In a preferred form of the alternate embodiment of the closure illustrated in FIG. 14, the attachment portion 166 of the spear 160 is thermally bonded to the top surface of the membrane 126.

Figure 15:
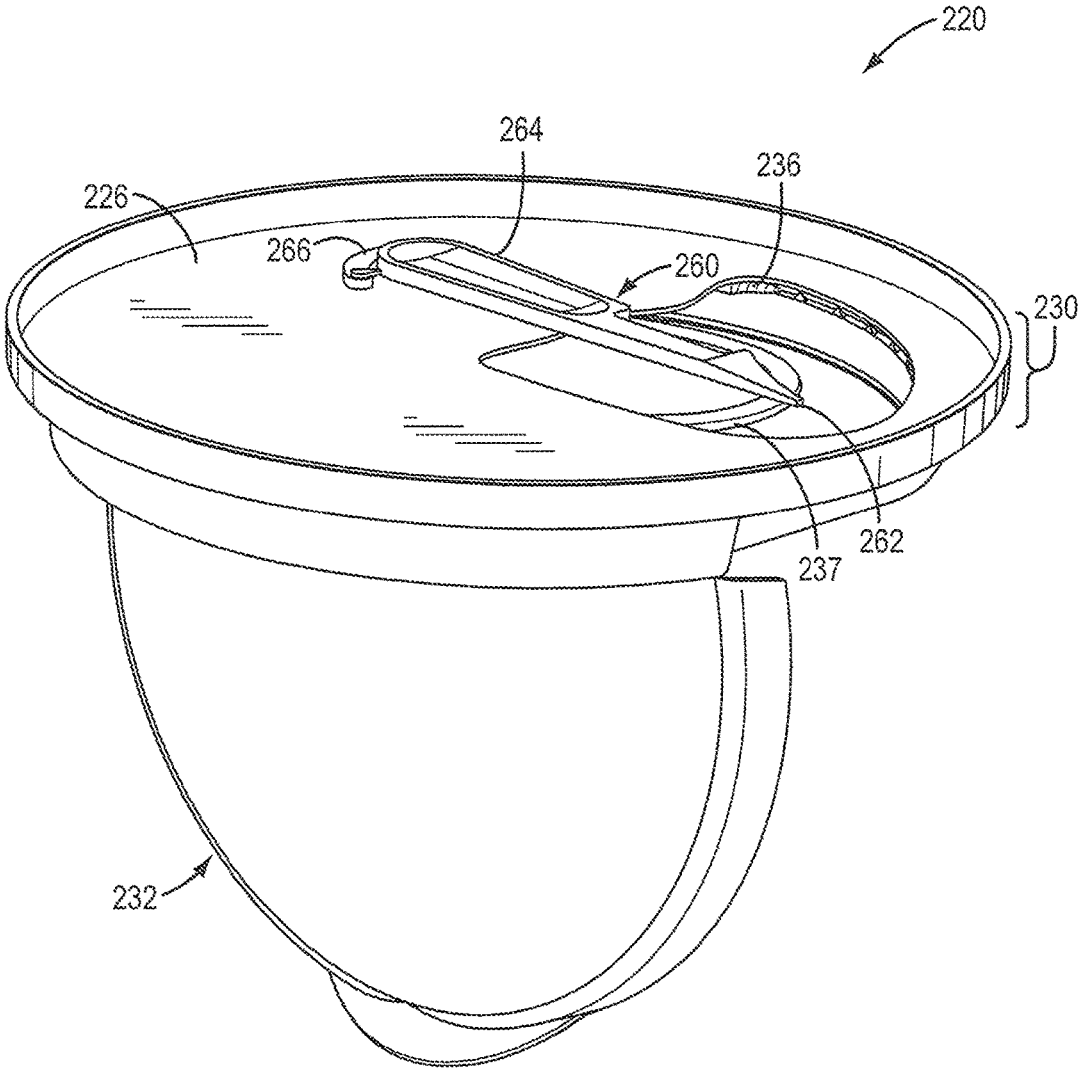
FIG. 15 shows yet another embodiment of the closure.

FIG. 15 illustrates yet another embodiment of the closure, and this embodiment is designated generally by the reference number 220 in FIG. 15. The closure 220 includes a closure body 230, a lid 232, a membrane 226 (partially broken away in FIG. 15), and a pull ring 236 that includes a finger pull loop 237. These elements are identical, or substantially identical, to the analogous elements of the first embodiment of the closure 20 described above in detail with reference to FIGS. 1-13.

The alternate embodiment of the closure 220 illustrated in FIG. 15 also includes a utensil, in the form of a food item spear 260, but the spear 260 is attached to the bottom surface of the membrane 226. As with the embodiment of the closure 120 shown in FIG. 14 and described above, the spear 260 in the embodiment shown in FIG. 15 includes a point or barbed spear tip 262, a handle portion 264, and an attachment portion 266. In the preferred form of the closure 220, the spear 260 is attached to the underside of the membrane 226 by thermally bonding the attachment portion 266 to the membrane 226.

Figure 16:
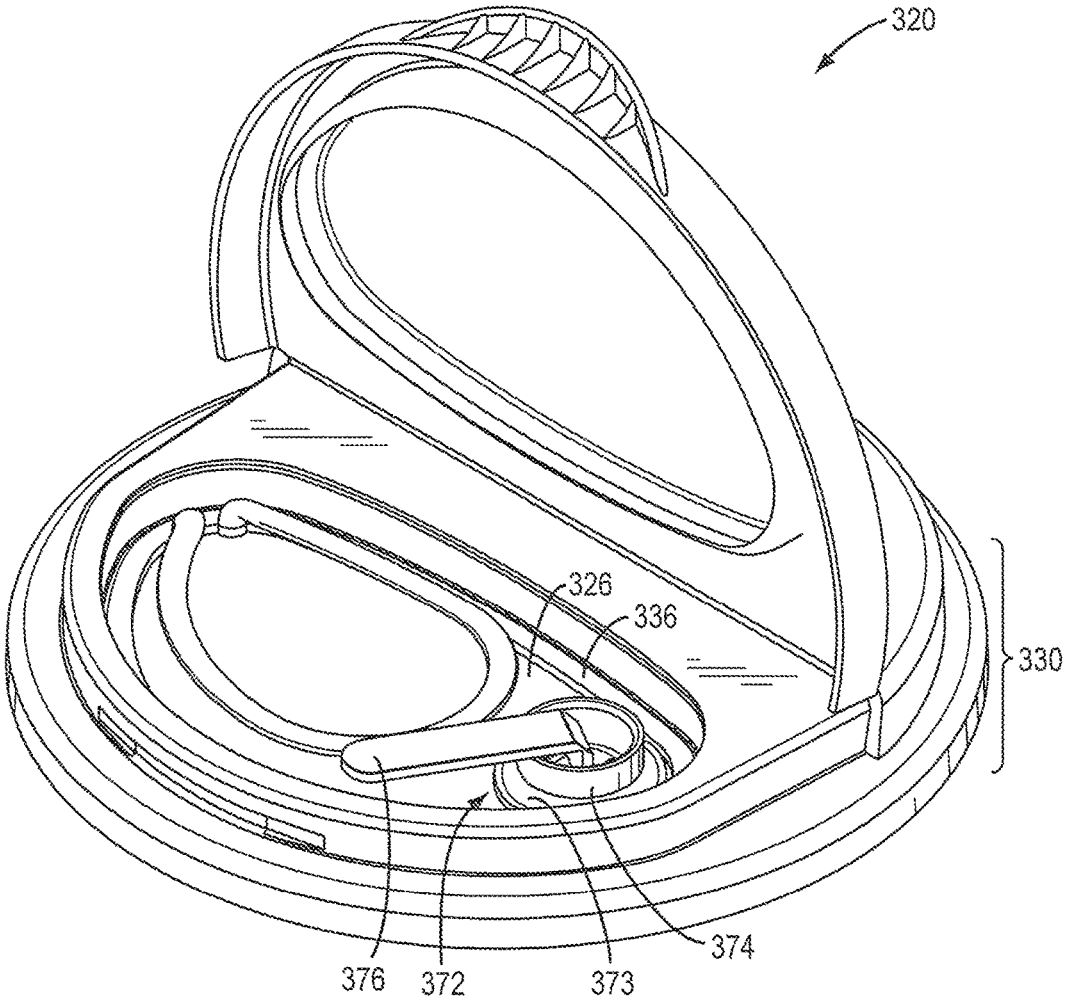
FIG. 16 is an isometric view, as viewed from above, of yet another embodiment of the closure, and in FIG. 16 the closure is shown with the lid in the open condition.
Figure 17:
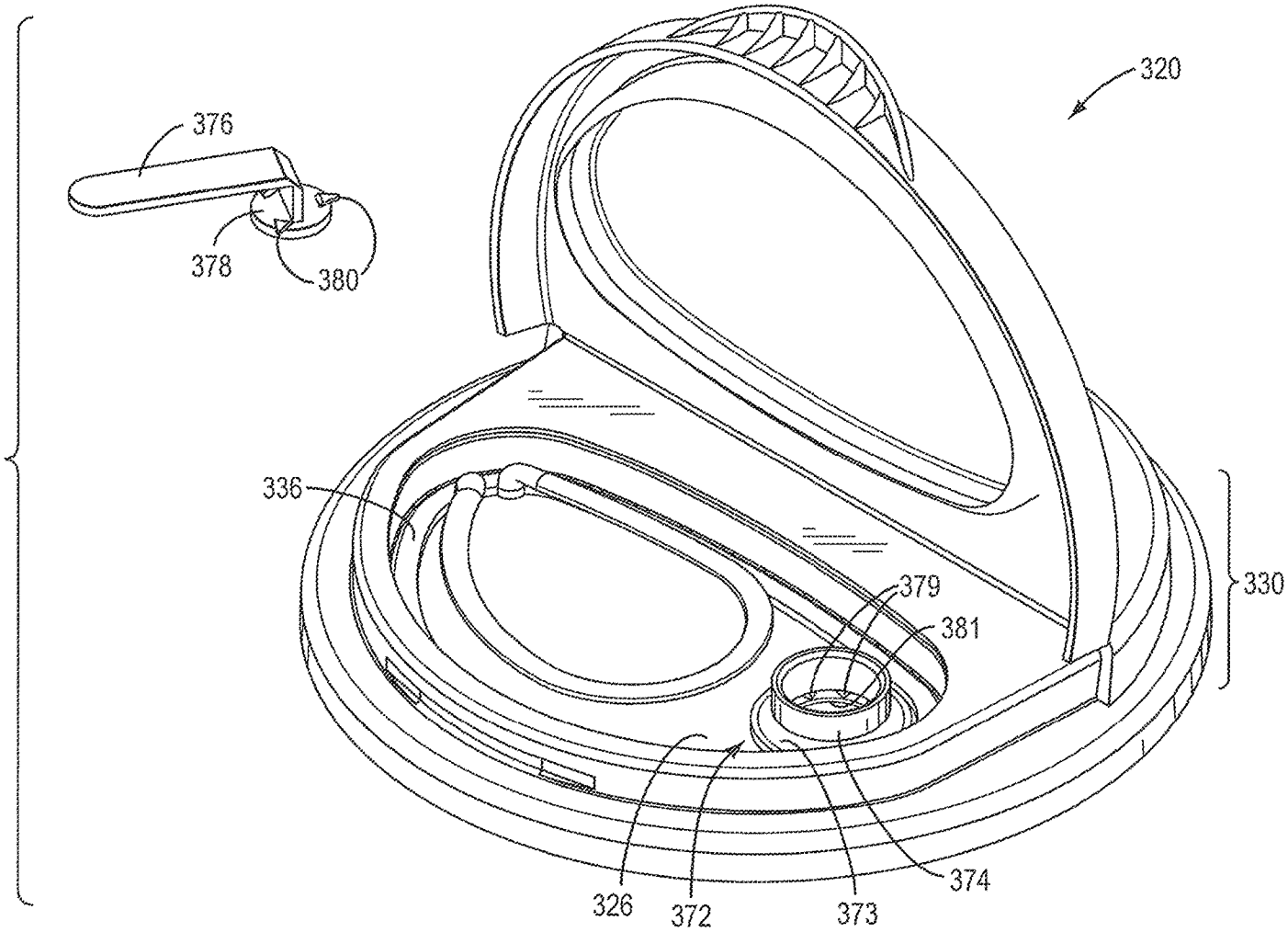
FIG. 17 is a view similar to FIG. 16, but FIG. 17 shows the closure after removal of a removable small dispensing orifice cover disc.
Figure 17A:
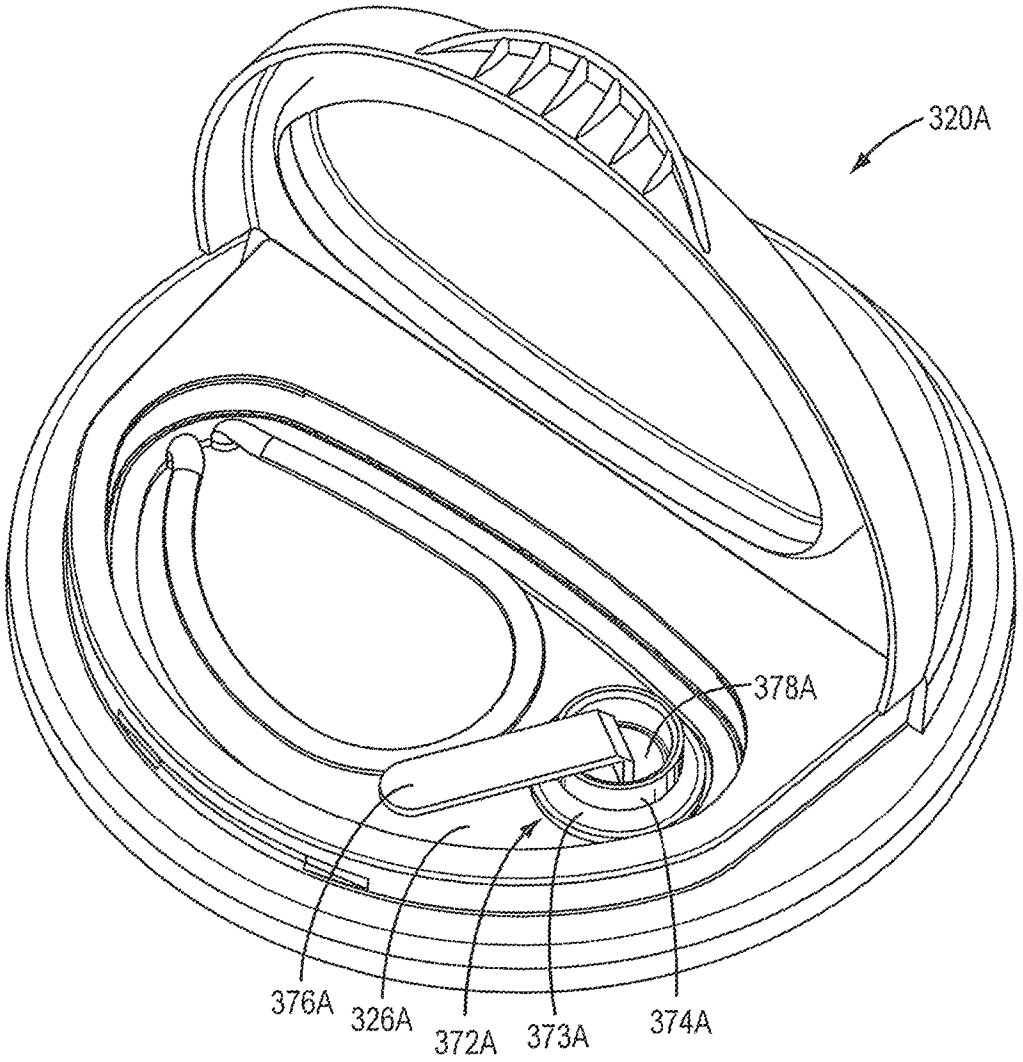
FIG. 17A is an isometric view similar to FIG. 16, but FIG. 17A shows yet another embodiment of the closure, and in FIG. 17A the closure is shown with the lid in the open condition.

FIGS. 16 and 17 show yet another embodiment of the closure of the present invention, and in FIGS. 16 and 17 the closure is designated generally by the reference number 320. The closure 320, including a closure body 330, has a configuration which is identical, or substantially identical, to that of the first embodiment of the closure 20 described above with reference to FIGS. 1-13. The closure 320 differs only in that a small dispensing orifice structure 372 is provided on the membrane 326 within the pull ring 336. The small dispensing orifice structure 372 includes an annular base 373 mounted on, and attached to, the membrane 326 (by thermal bonding, or otherwise) and an upwardly extending annular wall 374. The structure 372 also includes a pull tab 376 and a removable cover disc 378, the underside of which is thermally bonded to the membrane 326.

As explained in detail hereinafter, the small dispensing orifice structure 372 can be opened first and used to drain off some liquid contents of a package prior to pulling off the main pull ring 336 to completely open the closure 320. For example, if the package contains fruit pieces in a liquid, then the user might want to pour off the liquid first through a smaller orifice defined by the small dispensing orifice structure 372 before pulling off the main pull ring 336 and creating the larger access opening to the container. However, the user would not be required to open the small orifice dispensing structure 372 at all. The user could instead initially only pull out the main pull ring 336 along with the attached portion of the membrane 326 to which is mounted the structure 372 (and that action would cause the closure body opening to be exposed upon tearing away the occluding portion of the membrane 326), and that would initially provide only a large access opening.

As can be seen in FIG. 17, the disc 378 is disposed at one end of the tab 376 in the annular base 373. The disc 378 includes a plurality of frangible bridges 380 which are initially molded unitary with the base 373 and which can be broken when sufficient force is exerted on the tab 376 by the user.

The underside of the disc 378 is attached (e.g., by thermal bonding or otherwise) to the top surface of the membrane 326. Teeth 379 (FIG. 17) are preferably provided on the downwardly facing bottom surface of the dispensing orifice structure base 373 just radially beyond the peripheral edge of the disc 378 to facilitate tearing away of a small circular portion of a membrane 326 from inside the dispensing orifice structure 372 to create a small dispensing orifice 381 (FIG. 17). In this form of the closure 320 illustrated in FIGS. 16 and 17, the structure 372 is separately molded apart from the large pull ring 336. In another form of the closure 320 (not illustrated), an outer edge of the base 373 is connected to the inner edge of the large pull ring 336 so that the entire small dispensing orifice structure 372 can be molded unitary with the pull ring 336.

After the user has finished dispensing the desired amount of contents through the small dispensing orifice, the user may then pull the large pull ring 336 to tear away the rest of the membrane 326 from the closure body opening to provide increased access through the closure body (as with a scoop or spoon, or by pouring).

FIGS. 17A, 17B, 17C, 17D, and 17E illustrate yet another embodiment of the closure of the present invention, and in FIGS. 17A-17D the closure is designated generally by the reference number 320A. The closure 320A has a configuration which is identical to that of the embodiment of the closure 320 described above with reference to FIGS. 16 and 17 except that the closure 320A has a somewhat different small dispensing orifice structure 372A (FIG. 17A) which is next described in detail. The small dispensing orifice structure 372A includes an annular base 373A mounted on, and attached to, the membrane 326A (by thermal bonding, or otherwise), and the structure 372A further includes an annular wall 374A extending upwardly from the base 373A.

Figure 17B:
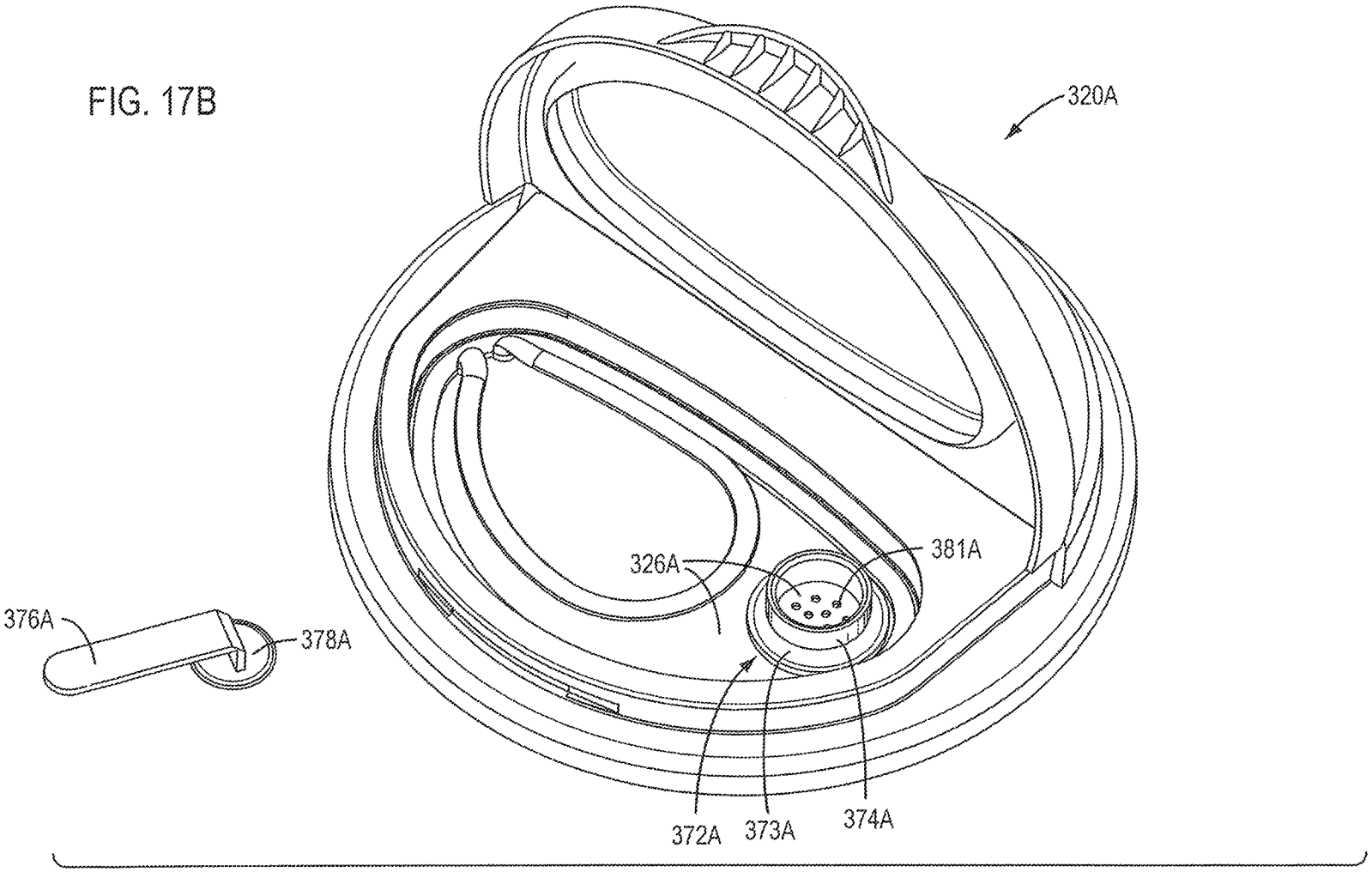
FIG. 17B is a view similar to FIG. 17A, but FIG. 17B shows the closure after removal of a removable small dispensing orifice cover disc.
Figure 17C:
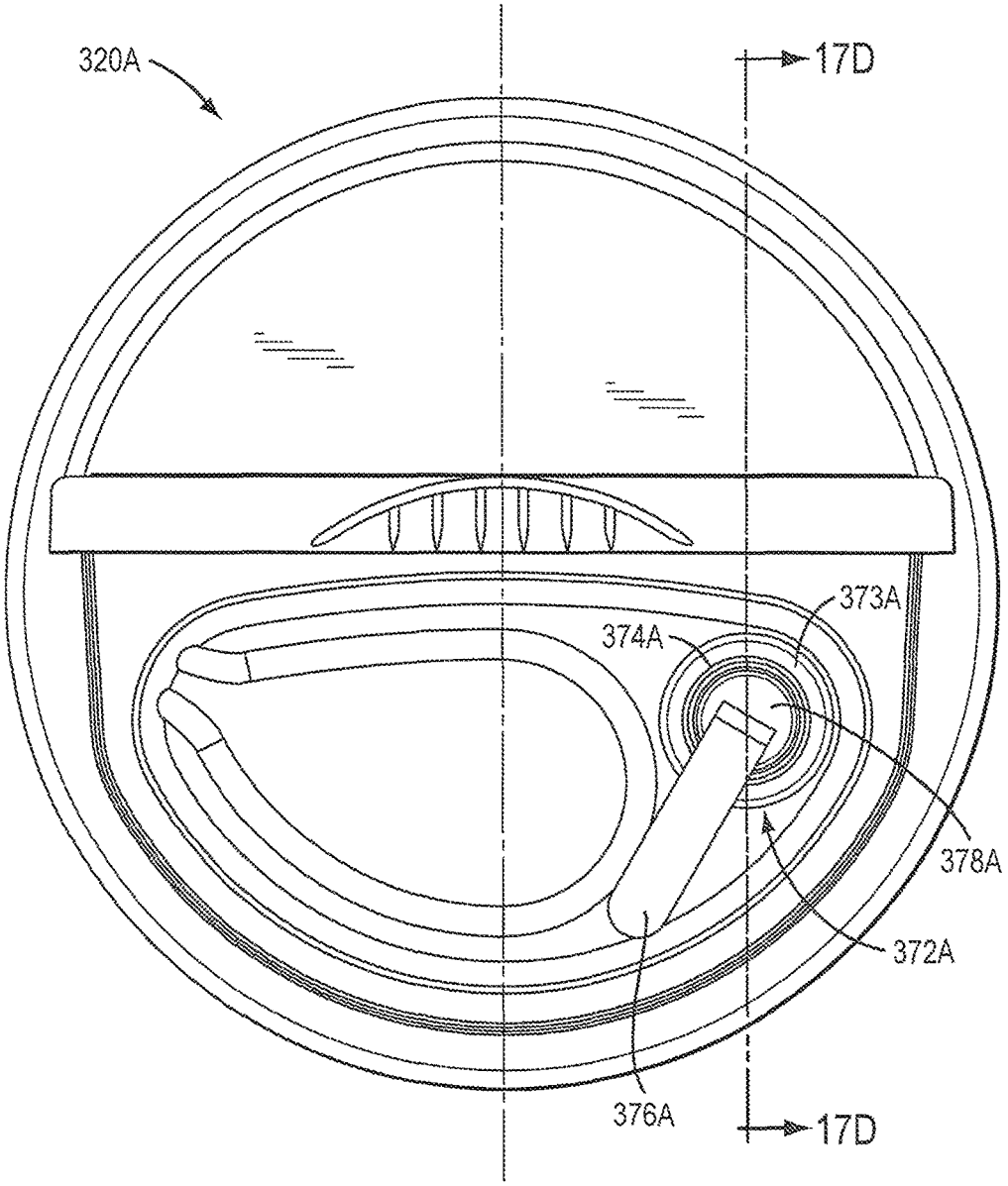
FIG. 17C is a plan view of the closure shown in FIG. 17A prior to removal of the small dispensing orifice cover disc.
Figure 17E:
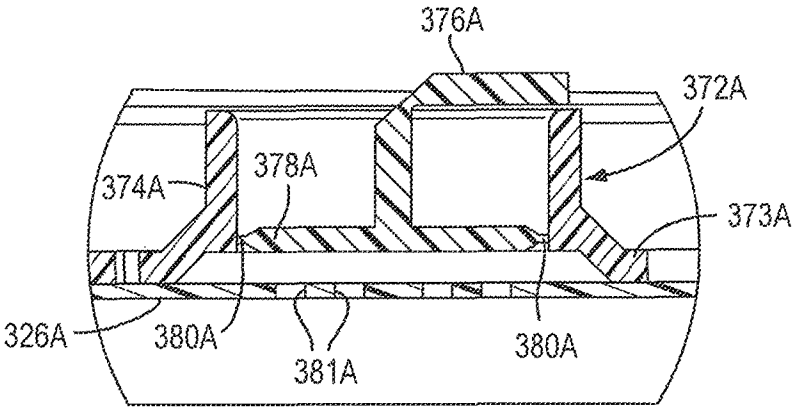
FIG. 17E is a greatly enlarged, fragmentary, cross-sectional view of a portion of the structure enclosed in the circle designated "FIG. 17E" in FIG. 17D, and in FIG. 17E the thickness of the membrane is exaggerated for ease of illustration and clarity.
Figure 17D:
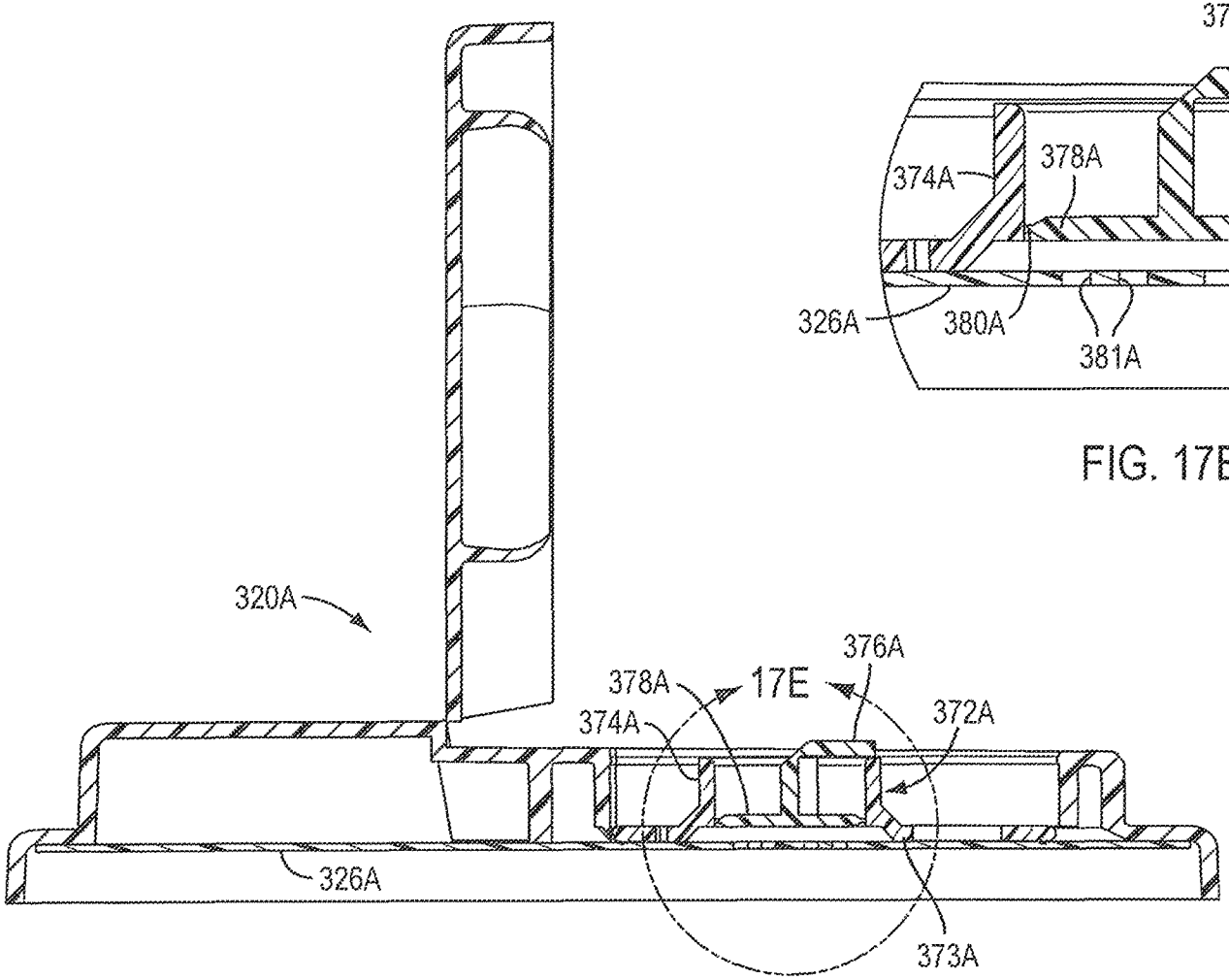
FIG. 17D is a cross-sectional view taken generally along the plane 17D-17D in FIG. 17C.

The structure 372A also includes a pull tab 376A extending from a circular, removable cover disc 378A. As can be seen in FIG. 17E, the periphery of the disc 378A is attached at the bottom of the annular wall 374A to a generally cylindrical surrounding portion of the structure 372A by a frangible, reduced-thickness portion of material 380A. The disc 378A is spaced above the membrane 326A. When the user exerts sufficient force on the tab 376A, the disc 378A can be broken away (as illustrated in FIG. 17B).

In the initial condition as provided to the user, the removable cover disc 378A is located over a portion of the membrane 326A, and the portion of the membrane 326A that underlies the removable cover disc 378A defines a plurality of small dispensing orifices, apertures, or openings 381A. The small dispensing orifices 381A are, of course, not exposed until the user opens the lid and pulls the tab 376A to tear away the disc 378A. Such a small dispensing orifice structure 372A might be useful for initially sprinkling the product (e.g., salt, pepper, sugar, etc.) prior to opening the main, larger opening of the closure to provide increased access for removing larger amounts or bulk amounts of the product (as with a scoop or spoon, or by pouring).

In the embodiment shown in FIGS. 17A-17E, wherein the membrane defines the pre-formed small dispensing orifices or openings 381A, the membrane 378A may be characterized as extending across at least a portion of the closure body opening.

Figure 41:
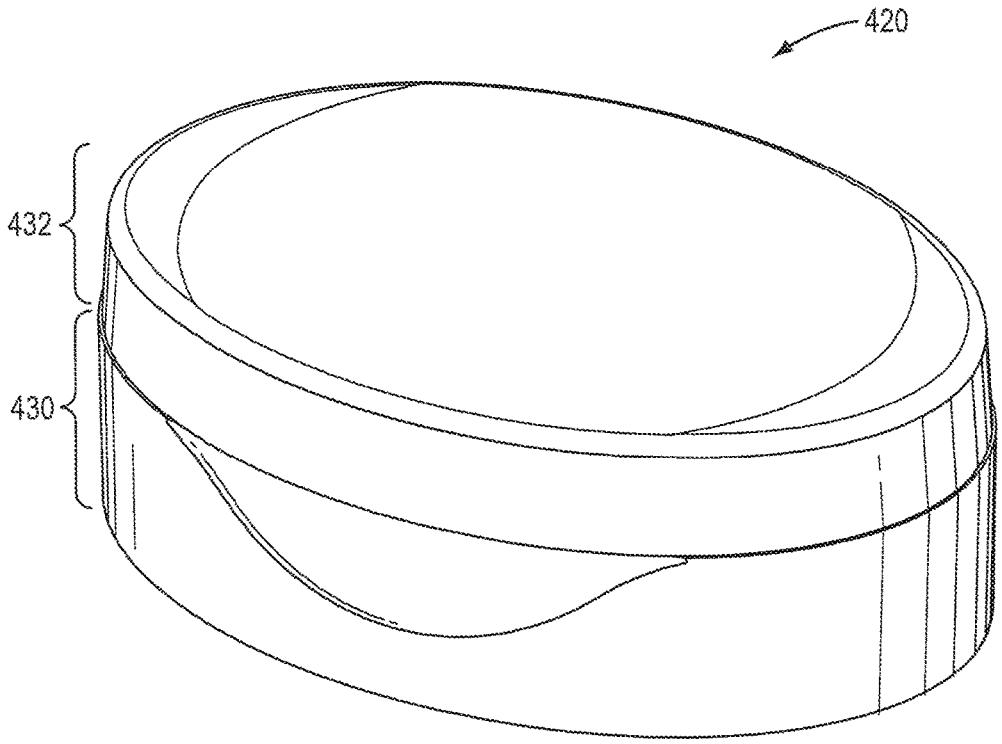
FIG. 41 is an isometric view of another alternate embodiment of a closure of the present invention.

FIG. 41 illustrates yet another embodiment of the closure of the present invention, and in FIG. 41 the closure is designated generally by the reference number 420. The closure 420 includes a closure body 430 and a lid 432 that present a different exterior aesthetic design configuration than does the previously described first embodiment of the closure 20 described above with reference to FIGS. 1-13. The body 430 and lid 432 each has a generally oval configuration instead of the circular configuration employed in the first embodiment of the closure 20. Also, in the alternate embodiment of the closure 420 illustrated in FIG. 41, the lid 432 is hinged at the rear of the lid (the hinge not being visible in FIG. 41). The closure 420 also differs from the closure 20 in that the front of the lid 432 of the closure 420 does not include an outwardly projecting thumb lift like the thumb lift 70 of the closure 20 (FIG. 1), and the closure body 430 instead includes an inwardly concave finger recess 431. Despite the differences with respect to (1) the shape of the closure 420, (2) the location of the lid hinge, and (3) the use of thumb recess 431 instead of a projecting thumb lift on the lid, the functional features of the internal structures (not visible in FIG. 41) of the closure 420 are functionally analogous to the internal functional features of the closure 20 described above in detail with reference to FIGS. 1-13, and the closure 420 employs internal components and elements analogous to the internal components and elements, respectively, of the closure 20 described above in detail with reference to FIGS. 1-13.

The present invention is further directed to a method of making a closure embodying the principles of the present invention, wherein the closure includes a closure body for mounting on an associated container, with a tearable membrane attached to the closure body, and a pull ring, separate from the closure body, in turn, attached to the membrane. As will be further described, in one aspect of the present invention, it is contemplated that the method of making the present closure is effected by attaching the membrane to the closure body prior to attaching the pull ring to the membrane. In an alternative method of making the present closure, the pull ring is attached to the membrane, such as by attachment to a membrane-making web, with subsequent cutting of the membrane from the web, for attachment of the membrane and pull ring to the associated closure body.

With reference to FIGS. 18-32, the first method of making a closure embodying the principles of the present invention will now be described. As will be further described, FIGS. 18-24 illustrate attachment of a membrane 26 to a closure body 30, configured in accordance with the previously described embodiment illustrated in FIGS. 1-11 and 13. FIGS. 25-32 illustrate attachment of a pull ring 36 to membrane 26 previously attached to the closure body 30.

Figure 18:
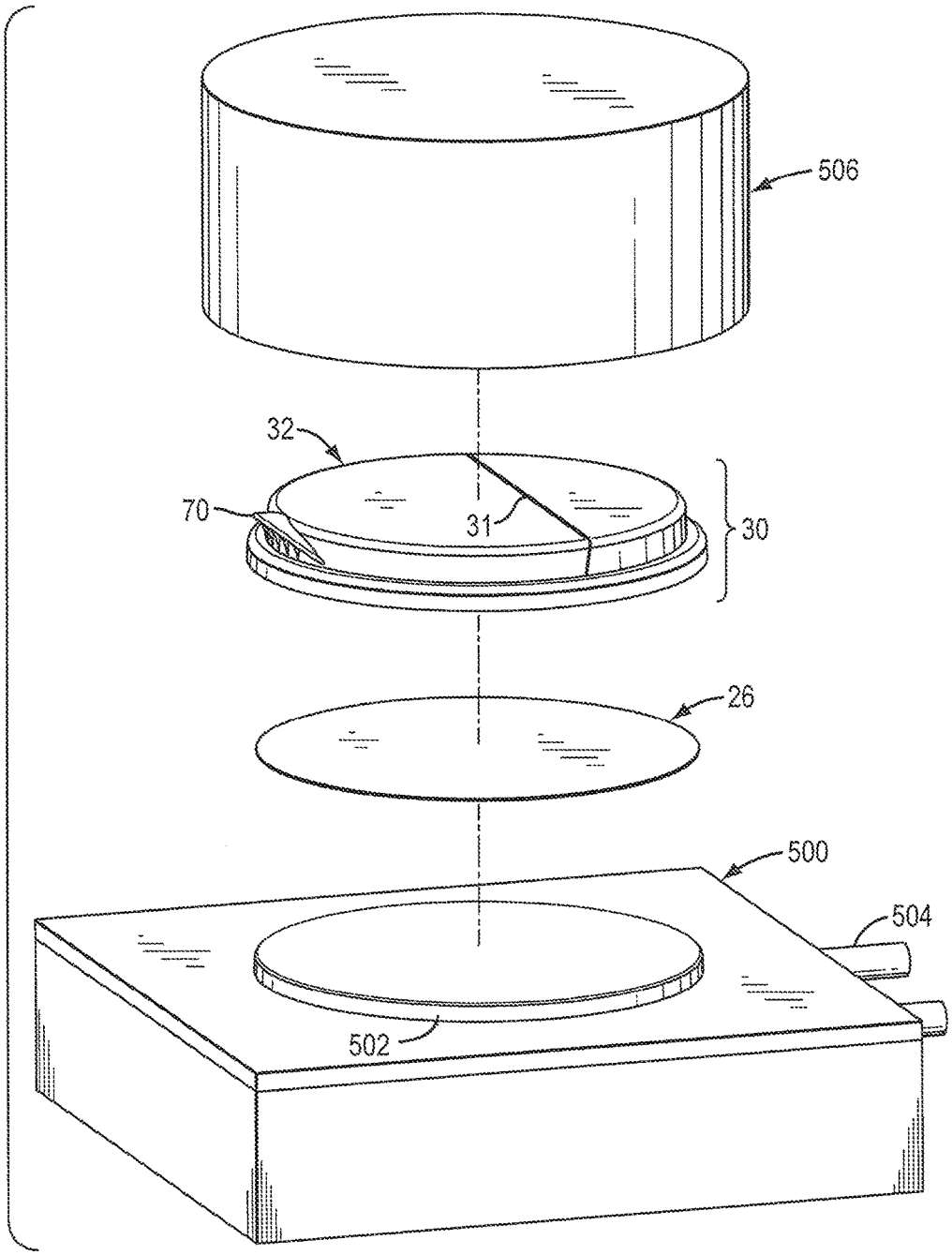
FIG. 18 is an exploded, isometric, diagrammatic view showing a low volume production process for assembling the first embodiment of the closure of the present invention illustrated in FIGS. 1-13.

With particular reference to the exploded, isometric, diagrammatic view of FIG. 18, therein is illustrated an induction welder 500 for effecting thermal bonding and attachment of membrane 26 to closure body 30. The induction welder 500 includes a nest 502 for receiving the membrane 26, with the nest 502 configured to position the membrane 26 in contact with the underside of closure body 30 when the closure body 30 is positioned on the nest 502, on top of the membrane 26.

The induction welder 500 includes an induction coil 504, with an associated pressure pad 506 moveable relative to the induction welder nest 502 for applying pressure to the closure body 30 during the induction welding process.

An exemplary induction welder for practice of the present invention is an Ambrell Easy Heat, Bapco Number WS2/4 and Number WS1/1, supplied by Ameritherm Induction Heating Limited, Saxon Way, Cheltenham, Gloucestershire, UK GL52 6RU.

Figure 19:
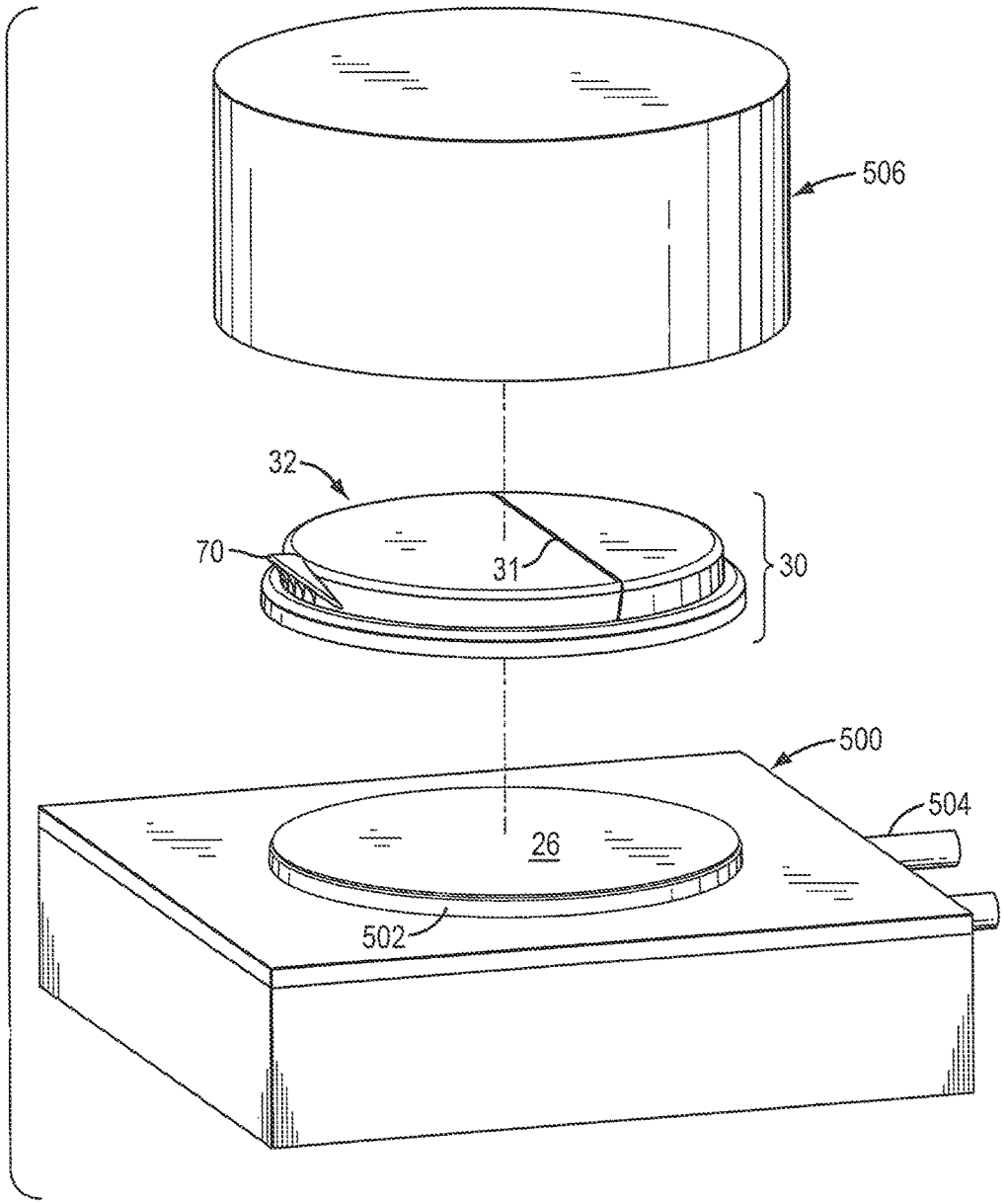
FIG. 19 is a view similar to FIG. 18, but in FIG. 19 the membrane is shown placed on the nest of a first thermal bonding machine.
Figure 20:
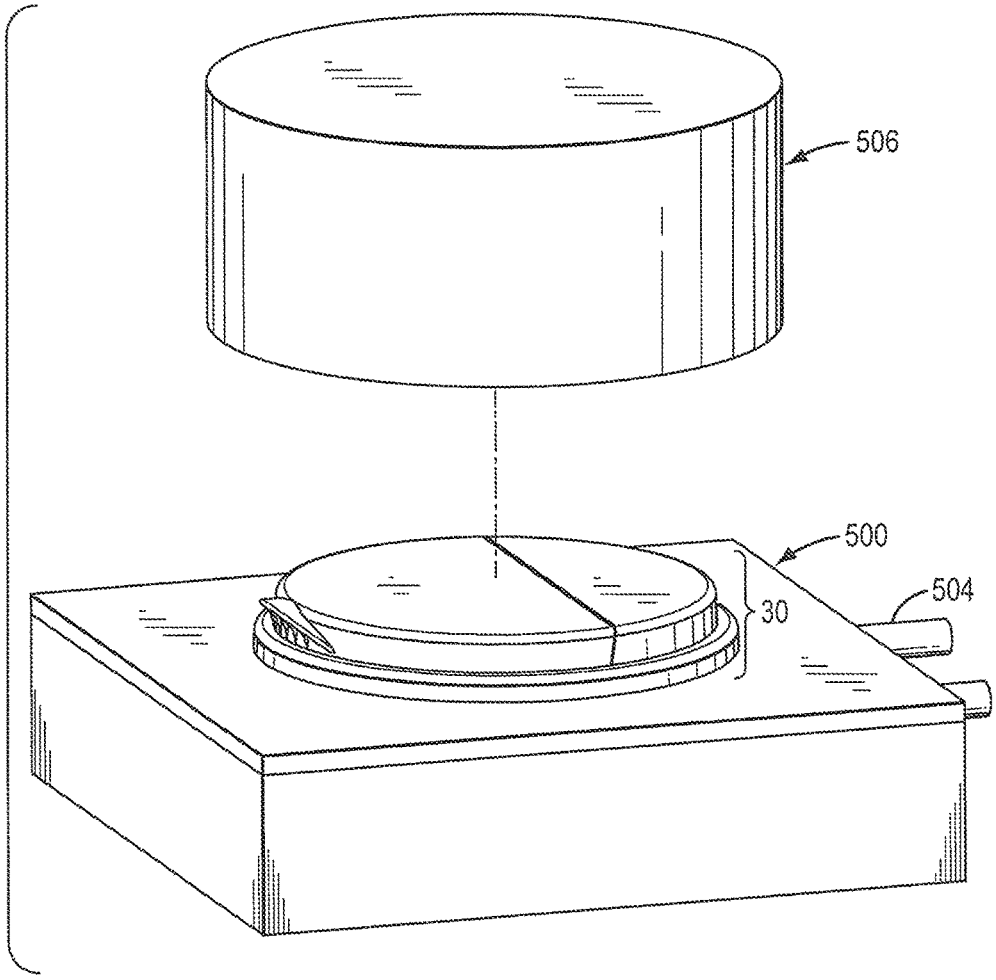
FIG. 20 is a view similar to FIGS. 18 and 19, but in FIG. 20, the closure has been lowered onto the membrane on the nest of the first thermal bonding machine.
Figure 21:
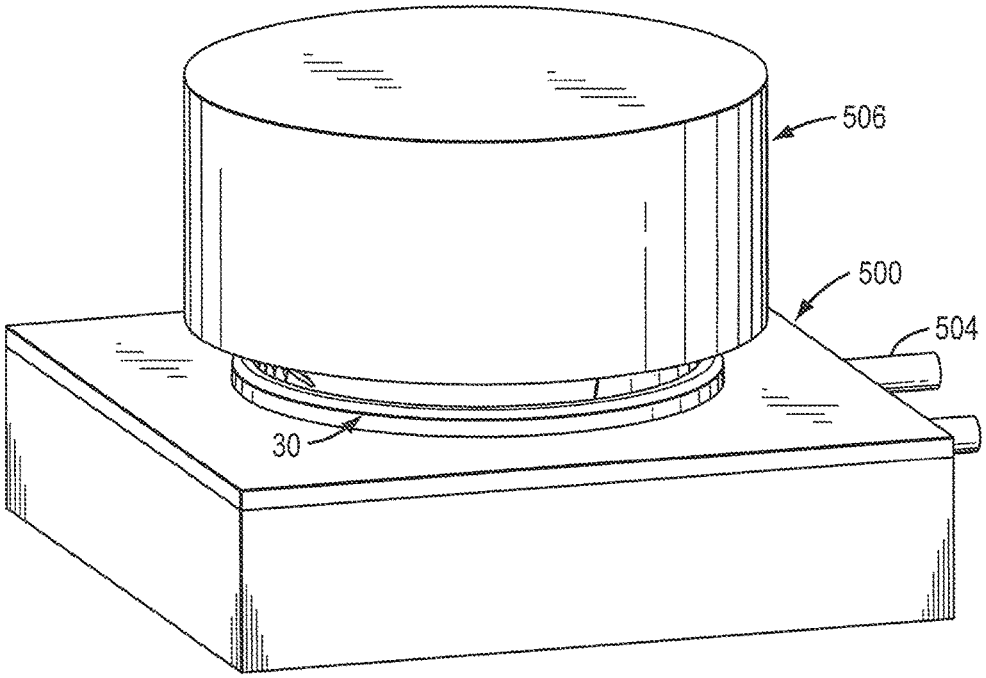
FIG. 21 is a view similar to FIGS. 18-20, but FIG. 21 shows the pressure pad of the thermal bonding machine lowered against the closure on the nest of the thermal bonding machine.
Figure 22:
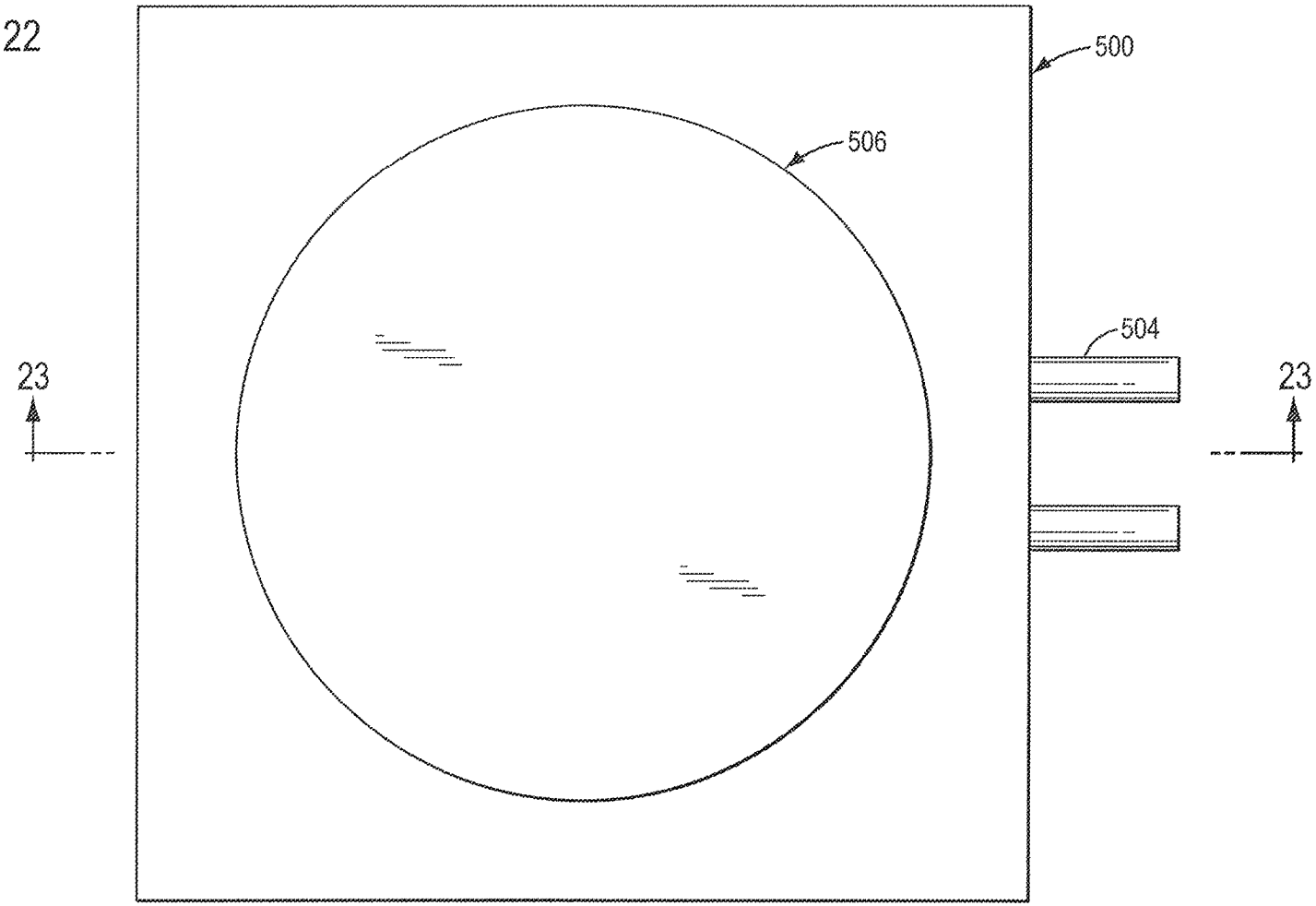
FIG. 22 is a diagrammatic plan view of the first thermal bonding machine and closure components shown in FIG. 21.
Figure 23:
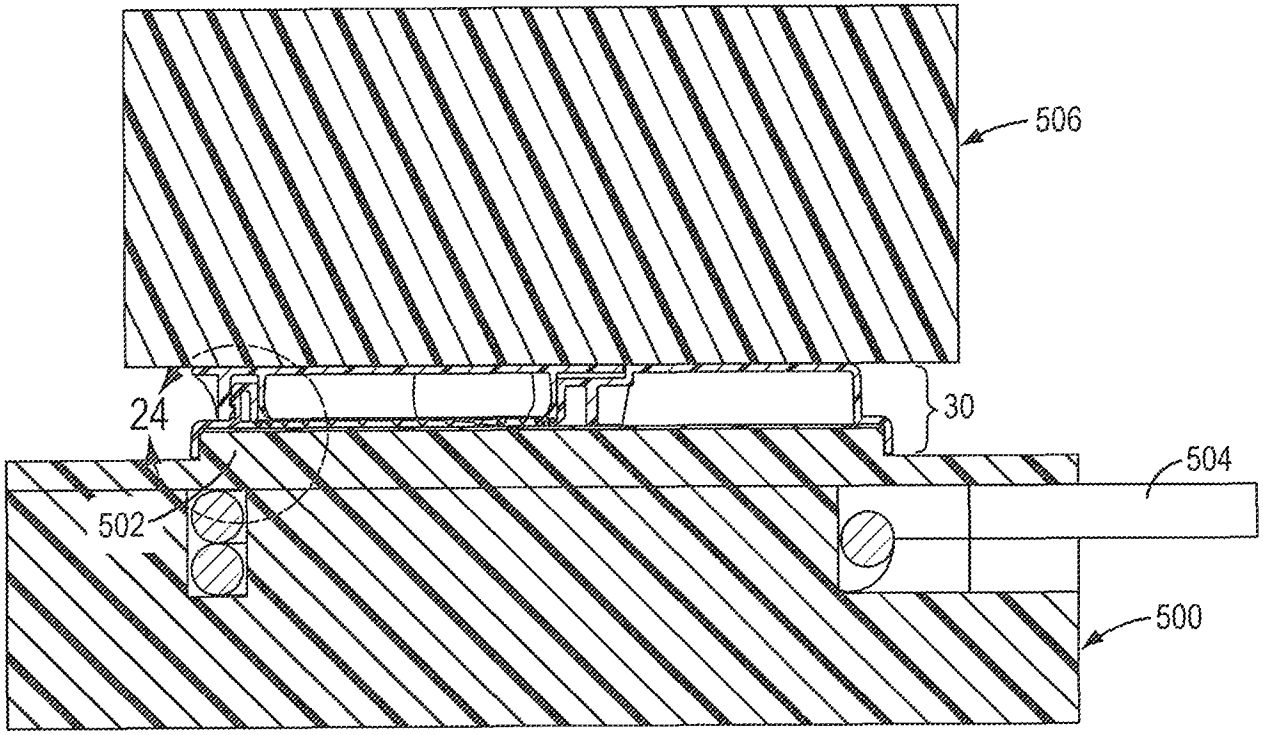
FIG. 23 is a diagrammatic, cross-sectional view taken generally along the plane 23-23 in FIG. 22.

With particular reference to FIG. 19, the present method is initiated by positioning membrane 26 on nest 502 of the induction welder 500 with the nest 502 having a shape which corresponds to, but is slightly smaller than, the membrane 26. Thereafter, as illustrated in FIG. 20, the closure body 30, with the lid 32 closed, is placed on the nest 502 of the induction welder 500, such that the membrane 26 is positioned against the underside of closure body 30.

Pressure pad 506 is next moved relative to the induction welder 500 as illustrated in FIGS. 21-24, whereby pressure is applied to the closed lid 32 which transfers force to the closure body 30, urging the closure body 30 into intimate contact with the membrane 26 positioned therebeneath. Induction welding is initiated by activation of induction coil 504, whereby the membrane 26 thermally bonded and is attached to the closure body 30 in sealing relationship.

In accordance with the presently preferred practice of the present invention, pressure applied to the closure lid 32 and body 30 by pressure pad 506 can be provided at between about 60 to 90 pounds. Induction current of 135-165 amperes is provided to the induction coil 504, with an induction time of the order of 0.9 to 1.5 seconds. This is followed by a cooling time of 1.0 seconds, with the resultant temperature of the laminate structure of the membrane 30 reaching between about 230 to 270° F.

Figure 24:
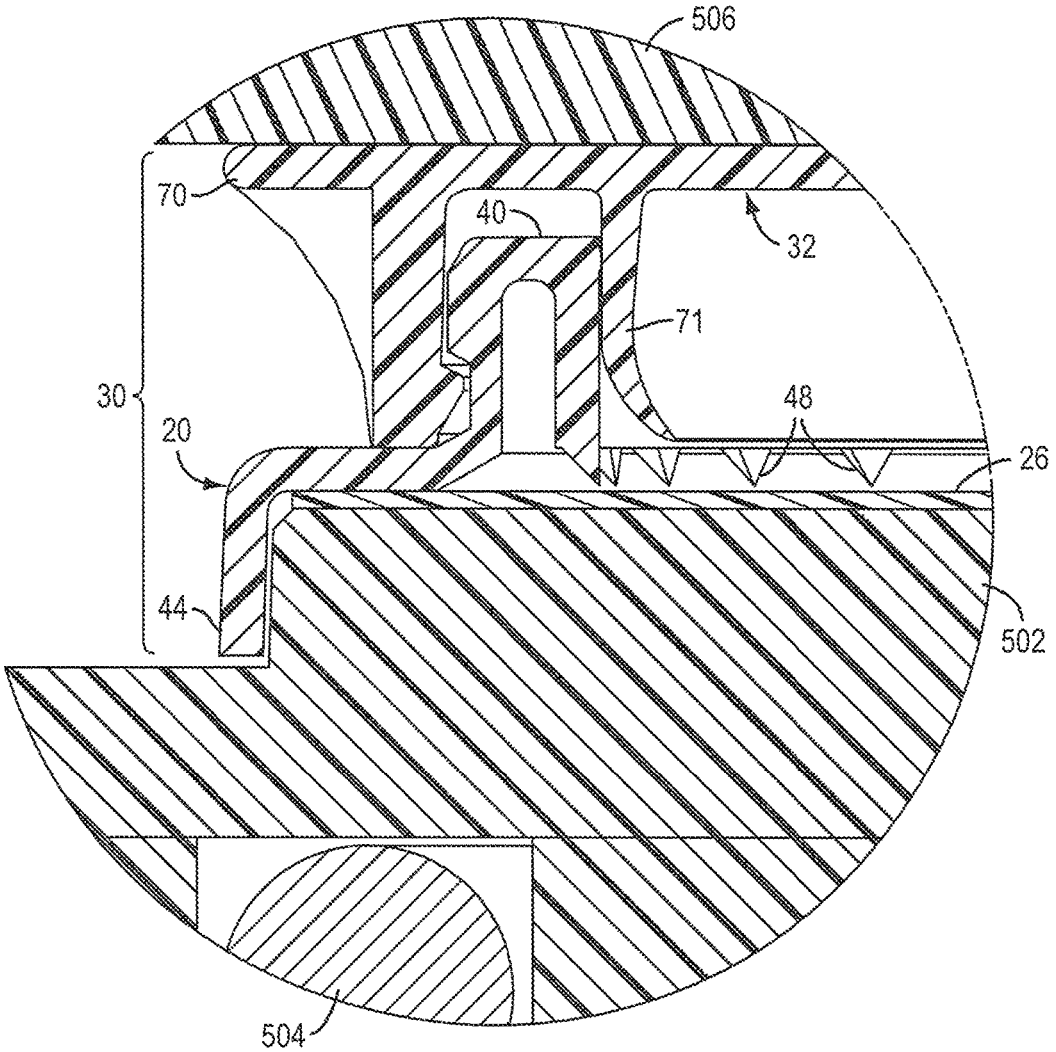
FIG. 24 is a greatly enlarged, fragmentary, cross-sectional view of a portion of the structure enclosed in the circle designated "FIG. 24" in FIG. 23, and in FIG. 24 the thickness of the membrane is exaggerated for ease of illustration and clarity, and in FIG. 24 the closure components and the first thermal bonding machine are shown wherein the closure lid interior spud is pressed against the top surface of a portion of the pull ring (causing deformation or flexing of the spud) so as to insure good contact between the bottom surface of the pull ring and the top surface of the membrane during the induction heating step of the process.
Figure 25:
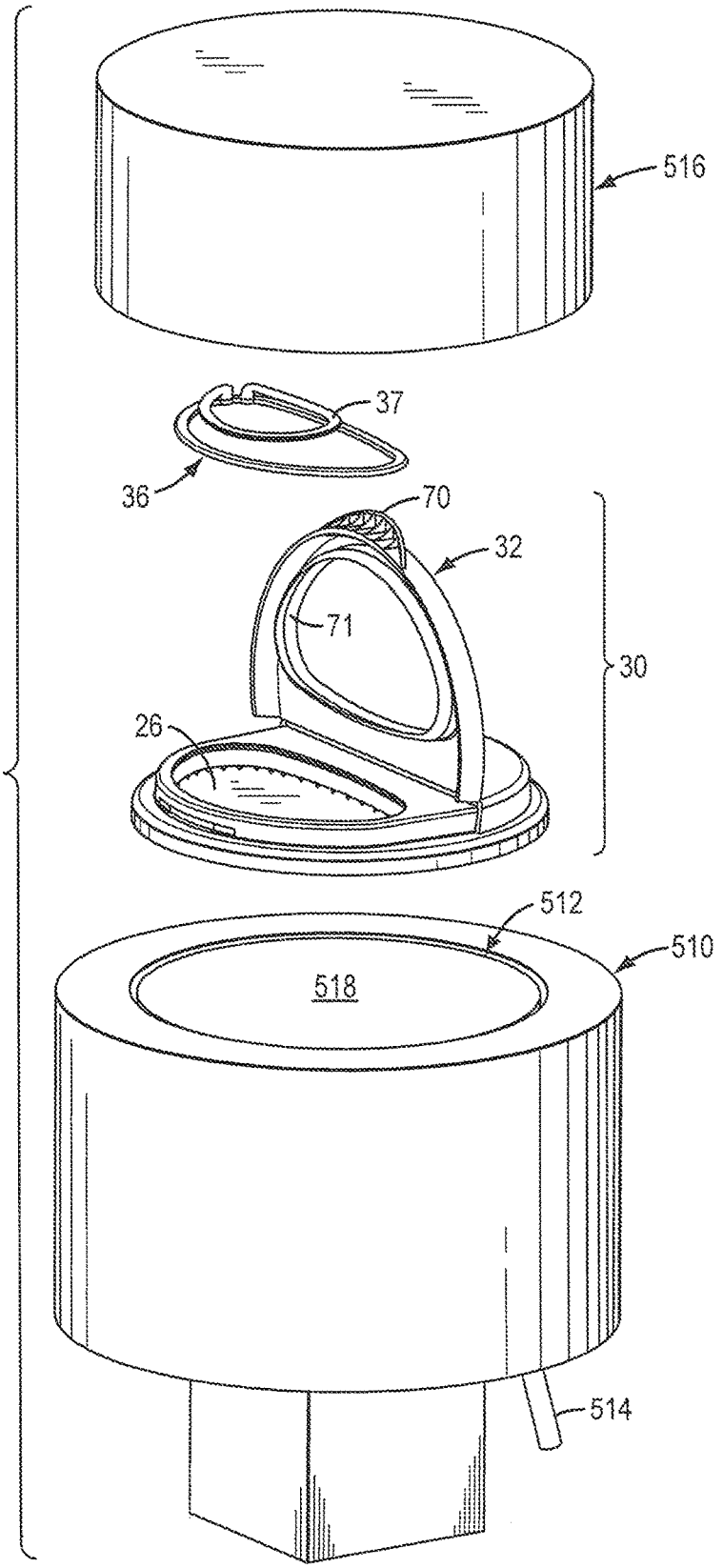
FIG. 25 is an exploded isometric view of a partially completed first embodiment of the closure positioned in relation to a second thermal bonding machine.

By induction welding of the membrane 26 to closure body 30, the membrane is attached to the closure body 30 so that the membrane 26 extends across at least a portion of the closure body opening (the opening being defined by the wall 25 as can be seen in FIG. 6). As illustrated in FIG. 24, the periphery of the membrane 26 is sealingly attached to the underside of the closure body 30, with the membrane 26 positioned for engagement and piercing by the teeth 48 of the closure body.

After the membrane 26 has been attached to the closure body 30, the assembled closure body and membrane are removed from the induction welder 500 for subsequent attachment of pull ring 36 to the membrane 26.

With particular reference to FIGS. 25-32, attachment and thermal bonding of the pull ring 36 to membrane 26 is effected by an induction welder 510 having a nest 512 upon which the assembled closure body and membrane are positionable. The induction welder 510 includes an induction coil 514, with an associated pressure pad 516 positioned in operative association with the induction welder nest 512 in order to apply pressure to pull ring 36 for attachment to membrane 26.

For practice of this aspect of the present invention, induction welder 510 may comprise a model MIT2 Induction Welder (Serial No. 4128), supplied by Relco UK Ltd., Imperial Way, Watford, England WD24 4JP.

Figure 26:
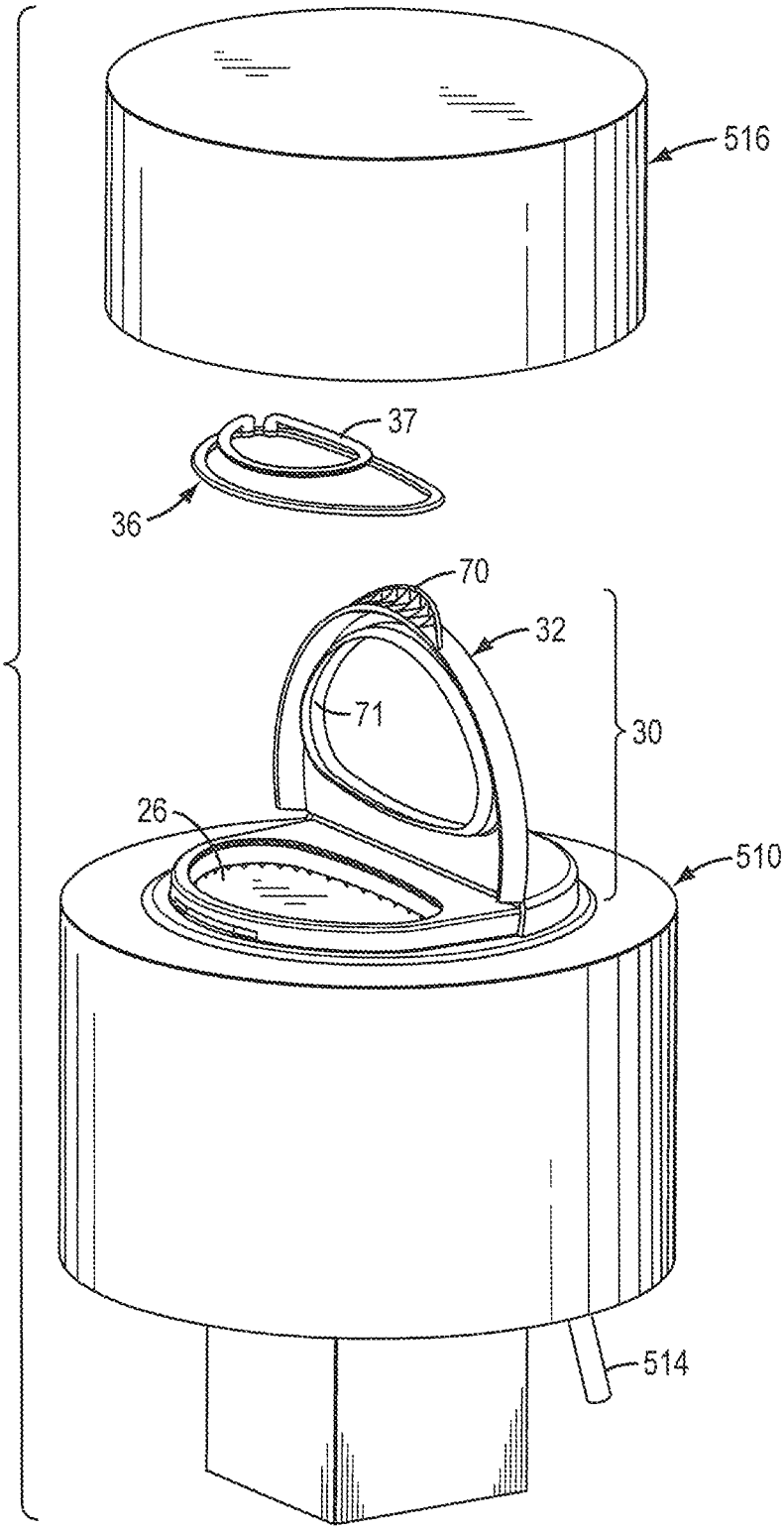
FIG. 26 is a view similar to FIG. 25, but in FIG. 26 the closure with the thermally bonded membrane has been placed on top of the open nest of the second thermal bonding machine with a non-stick or non-thermal bonding absorptive tape barrier (not visible) located on the underside of the closure membrane over the nest of the second thermal bonding machine.

For practice of this aspect of the present invention, an absorptive tape 518, having suitably non-adherent surfaces, is positioned on nest 512 of the induction welder 510. As shown in FIG. 26, the closure body 30 is next positioned on top of absorptive tape 518, with a lid 32 of the closure in the open configuration to expose, and provide access to, the upper surface of membrane 26.

Figure 27:
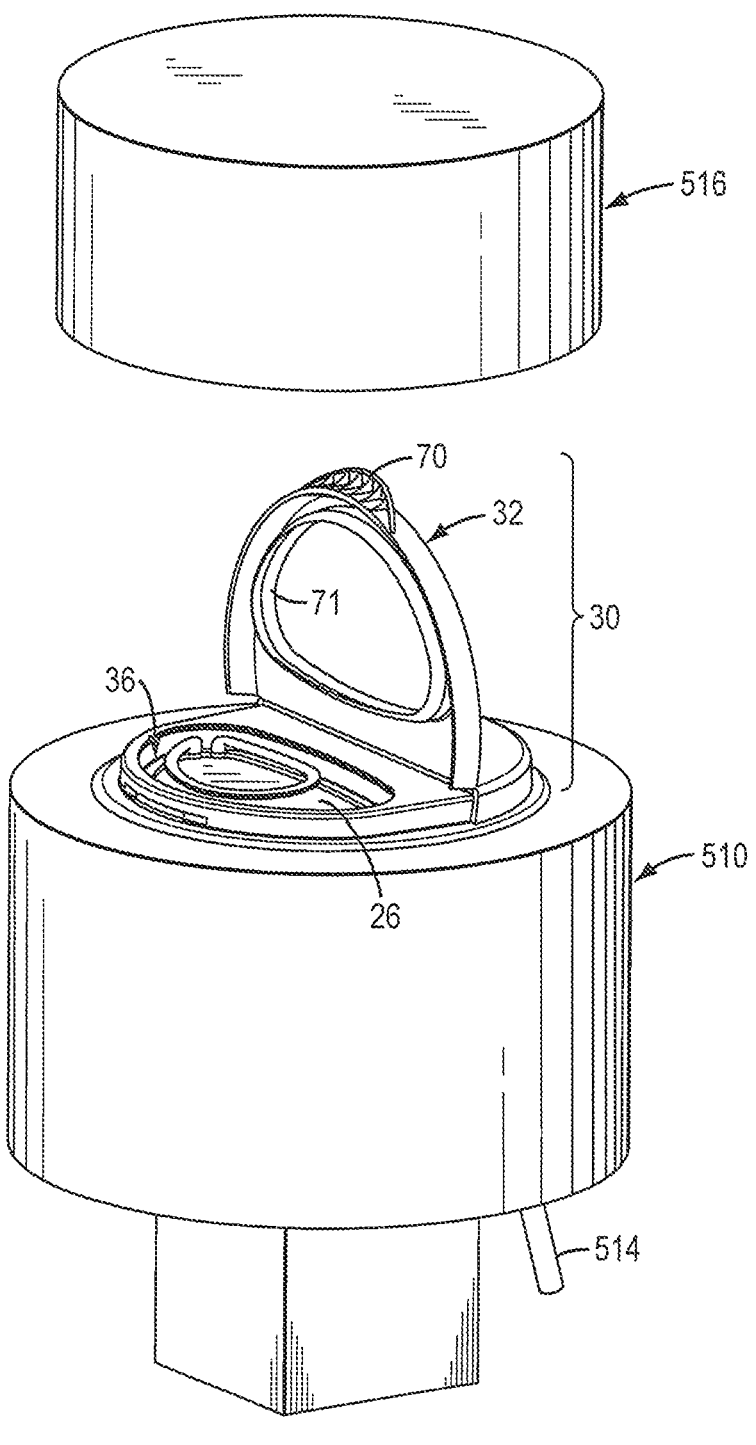
FIG. 27 is a view similar to FIG. 26, but in FIG. 27, the pull ring has been positioned on top of the upwardly facing surface of the closure membrane within the closure body.
Figure 28:
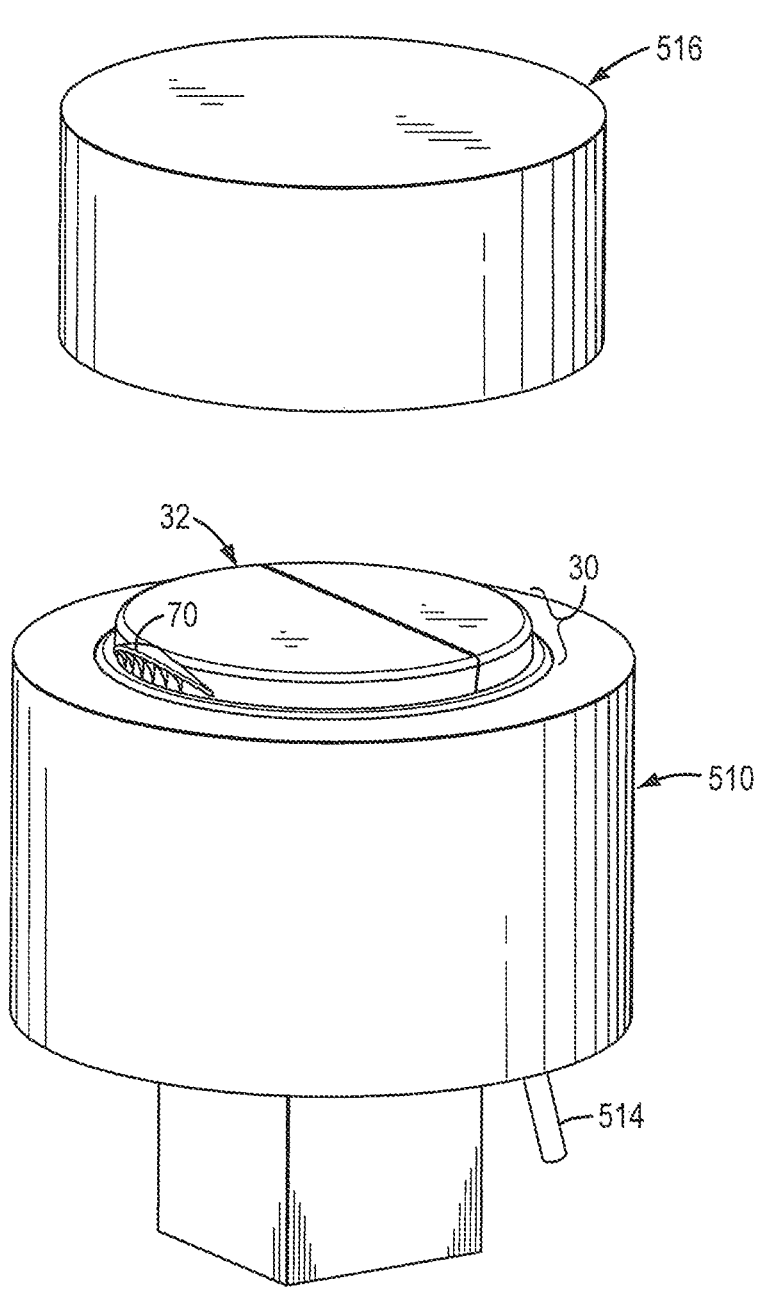
FIG. 28 is a view similar to FIG. 27, but FIG. 28 illustrates a further step in the process wherein the closure lid has been closed.
Figure 29:
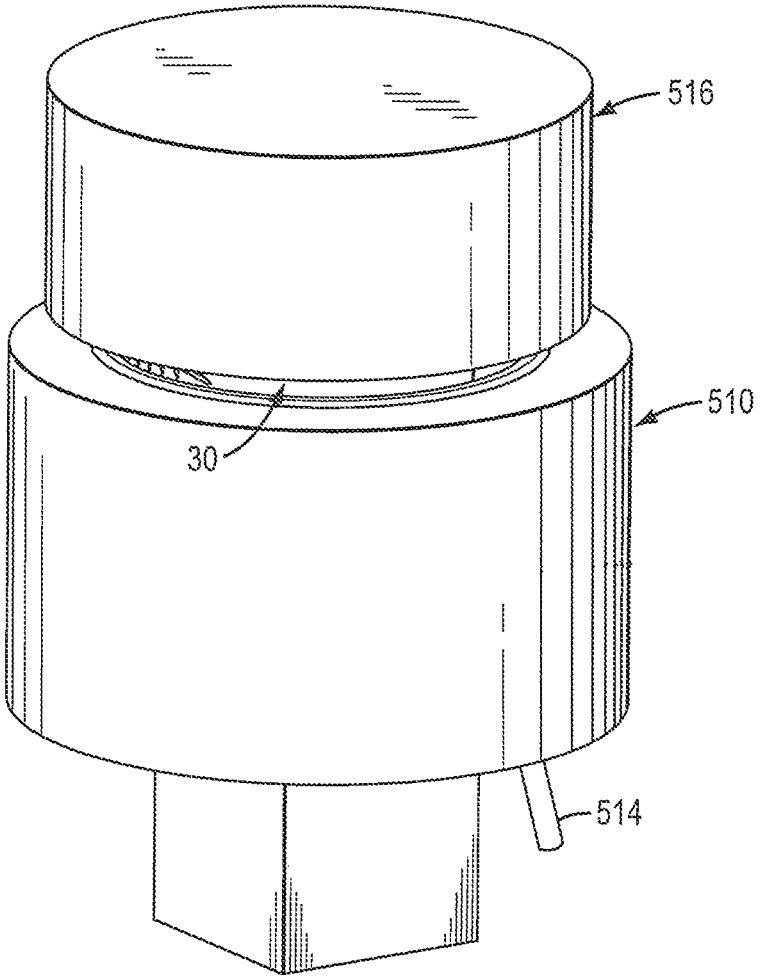
FIG. 29 is a view similar to FIG. 28, but FIG. 29 shows a further step in the process wherein the pressure pad of the second thermal bonding machine has been lowered against the closed closure, and wherein the induction heating system has been energized or excited to create or fuse of the thermoplastic material at the innerface of the membrane and pull ring.
Figure 30:
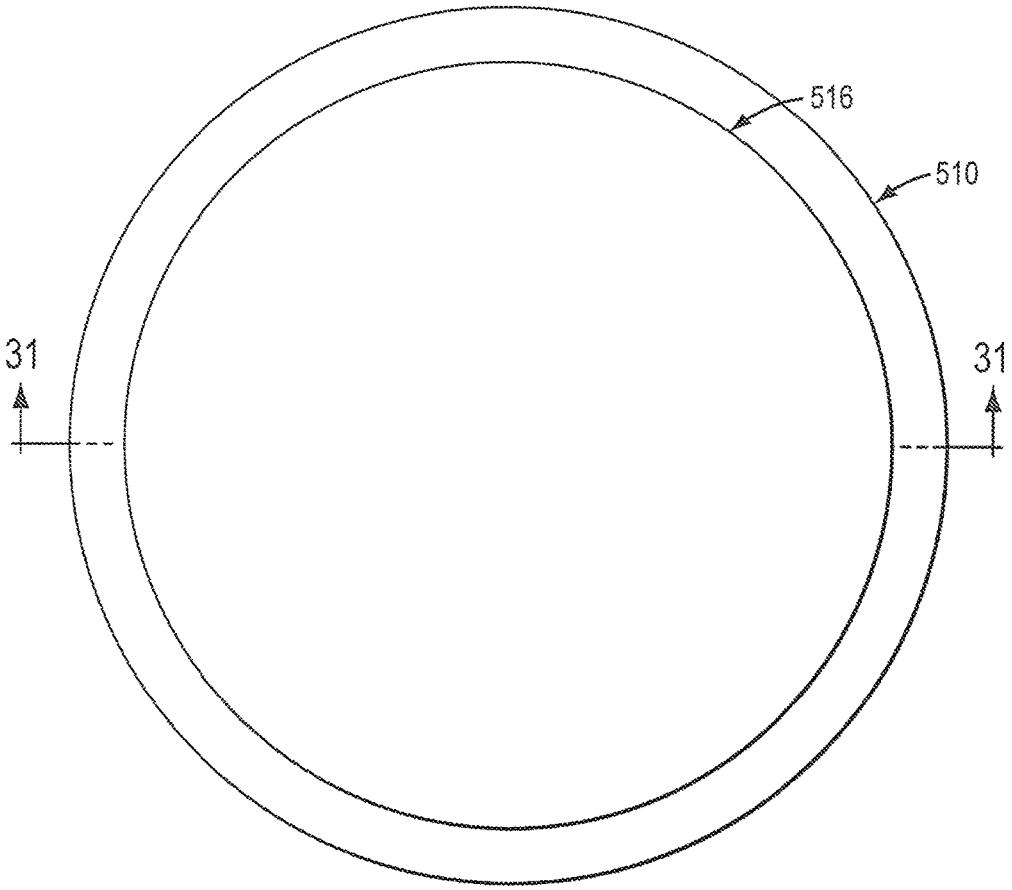
FIG. 30 is a diagrammatic, plan view of the components and machine in FIG. 29.
Figure 31:
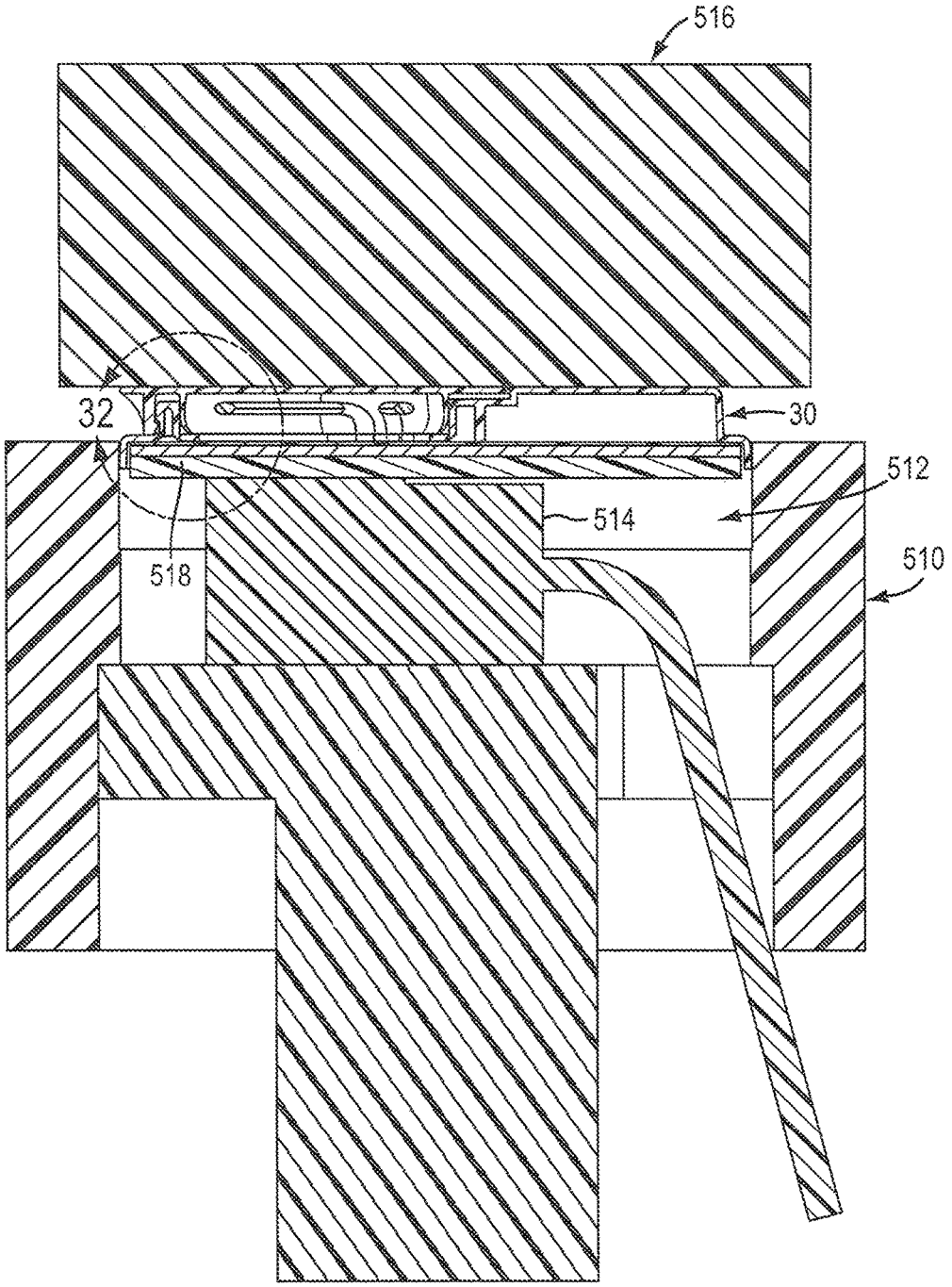
FIG. 31 is a cross-sectional view taken generally along the plane 31-31 in FIG. 30.
Figure 32:
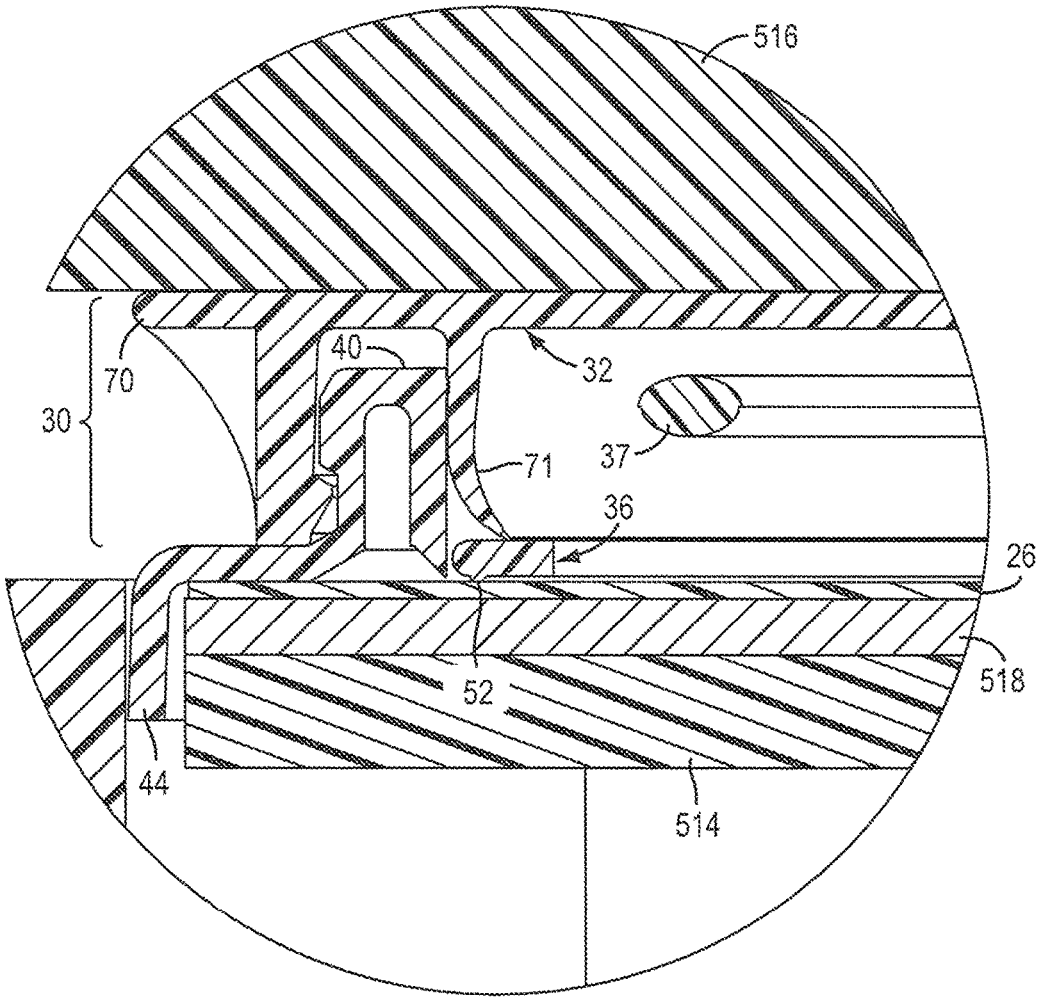
FIG. 32 is a greatly enlarged, fragmentary, cross-sectional view of a portion of the structure enclosed in the circle designated "FIG. 32" in FIG. 31, and in FIG. 32 the thickness of the membrane and non-thermal bondable absorptive tape is exaggerated for ease of illustration and clarity, and in FIG. 32 the closure components and the second thermal bonding machine are shown wherein the closure lid interior spud is pressed against the top surface of a portion of the pull ring (causing deformation or flexing of the spud) so as to insure good contact between the bottom surface of the pull ring and the top surface of the membrane during the induction heating step of the process.

As shown in FIG. 27, the pull ring 36 is next positioned on top of the membrane 26 within the opening defined by closure body 30. Thereafter, as shown in FIG. 28, the lid 32 of the closure 20 is closed, thus urging resilient spud 71 into engagement with the pull ring 36 positioned generally within the closure body 30 (see FIG. 32). The pressure pad 516 is then moved relative to the induction welder nest 512 and closure 20 to force the lid 32 against the closure body 30. Then, the induction coil 514 activated to inductively heat the laminate of the membrane 26 to create a thermal bond between the membrane 26 and the pull ring 36. As will be appreciated, the spud 71 of lid 32 has been particularly configured to provide the desired interference with the pull ring 36. The force of the pad 516 on the lid 32 deforms and deflects the spud 71 so that the spud 71 transfers pressure to the pull ring 36. As previously described, the pull ring 36 preferably defines a rib 52 (FIG. 3.2) which functions as a "weld concentrator" for facilitating thermal bonding of the pull ring 36 to the membrane 26.

For practice of this aspect of the present invention, pressure pad 516 is configured to exert pressure between about 60 to 180 pounds on the closure lid 32 and body 30.

An induction current of 135 to 165 amperes can be supplied to the induction coil 514, with an induction time 0.9 to 1.5 seconds, followed by a cooling time of 1.0 seconds. It is contemplated that as a result of induction welding in this manner, the laminate of the membrane 26 will reach a temperature of between about 230 to 270° F.

While engagement of spud 71 with pull ring 36 is illustrated, contact between pull ring 36 and membrane 26 can be effected in other ways, such as by leaving lid 32 of the closure open, and using a pressure pad shaped to fit inside the closure body opening for directly contacting the pull ring.

After the assembled closure 20 has cooled sufficiently, the pressure pad 516 can be moved relative to the induction welder 510 to permit the assembled closure 20 to be removed from the induction welder. The absorptive tape 518 is separated from the lower surface of the membrane 26 to complete the manufacture of the closure 20 with the separately molded pull ring 36 now attached to the membrane 26.

With reference now to FIGS. 33-40, therein is diagrammatically illustrated an alternative method for making a closure embodying the principles of the present invention, including a tearable membrane and pull ring separate from the body of the closure. In accordance with this aspect of the present invention, it is contemplated that higher rates of production can be achieved by attachment of the pull ring to the tearable membrane, prior to attachment of the membrane to the associated closure body. It is further contemplated that this can be achieved by attaching the pull ring to a web from which the membrane can be cut, then cutting the membrane, and thereafter attaching the membrane along with the pull ring to the associated closure body.

Figure 33:
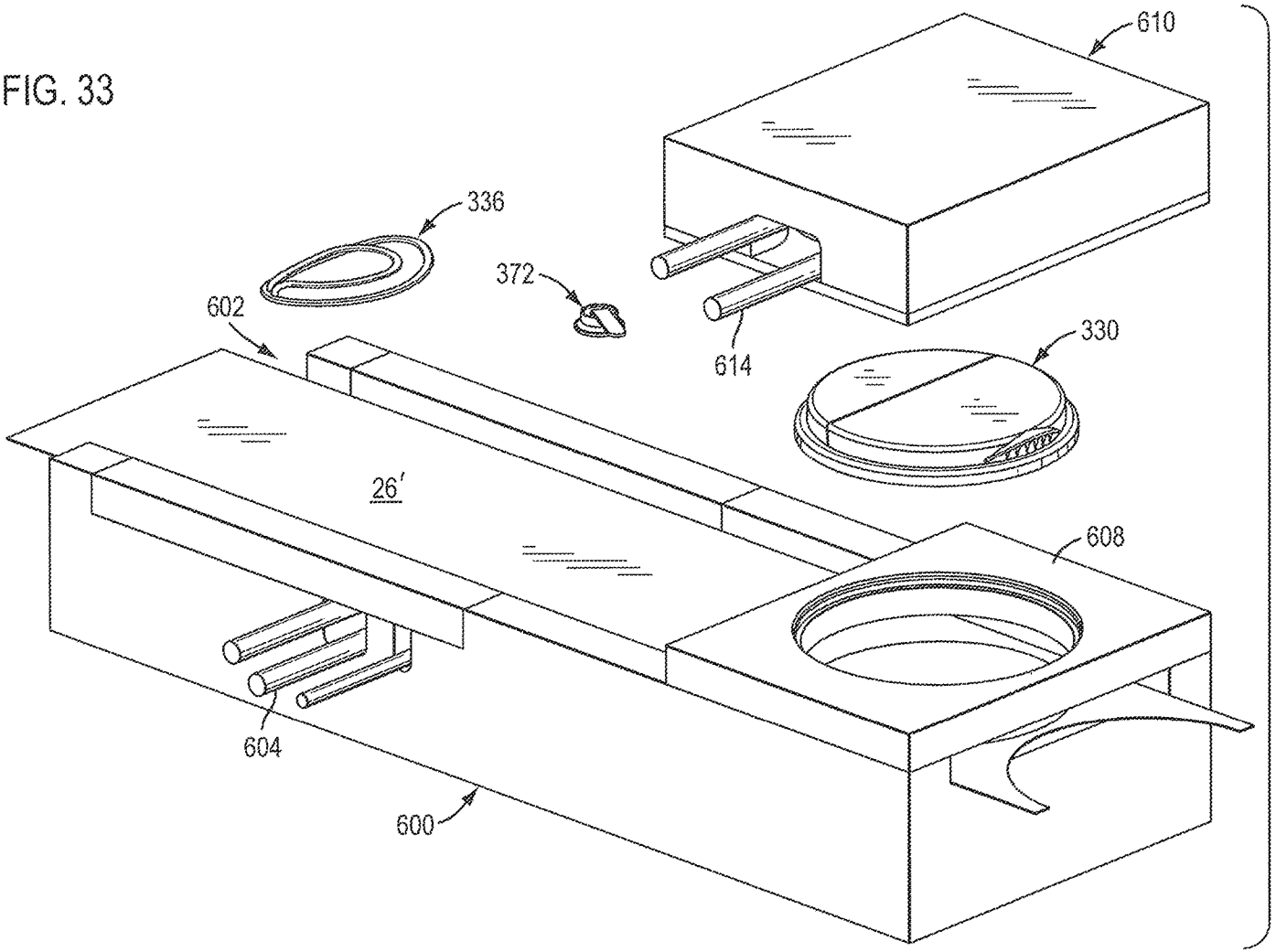
FIG. 33 is an exploded, isometric, diagrammatic view showing a step in a high-volume process for assembling the embodiment of the closure illustrated in FIGS. 16 and 17.

With particular reference to FIG. 33, therein is illustrated an exploded, isometric, diagrammatic view showing an arrangement for a high-volume process for making closures embodying the principles of the present invention. While it will be understood that practice of this aspect of the method of the present invention can be employed for making any of the previously-described embodiments of the present closure, this aspect of the method of the present invention will be described in association with the previously described closure 320 which is illustrated in FIGS. 16 and 17, and which includes a small dispensing orifice structure 372 provided on membrane 326 within the associated pull ring 336.

As illustrated in FIG. 33, practice of this aspect of the invention can be effected by use of an induction welding apparatus 600, which defines a generally elongated membrane guide region 602 along with a membrane web 26' can be positioned and moved for manufacture of the closure 320. The welding apparatus 600 includes an induction coil 604 and membrane die cutter 608, and a cooperating, vertically moveable membrane punch. Welding apparatus 600 is configured to effect thermal bonding of the pull ring 336 to the membrane web 26' from which the membrane 326 is cut and formed.

As illustrated in FIG. 33, an induction welder 610, having induction coil 614 is further provided for making the closure 320. Induction welder 610 is operable to bond the membrane 326 (cut from membrane web 26'), together with the pull ring 336 and the dispensing orifice structure 372, to the closure body 330.

Figure 34:
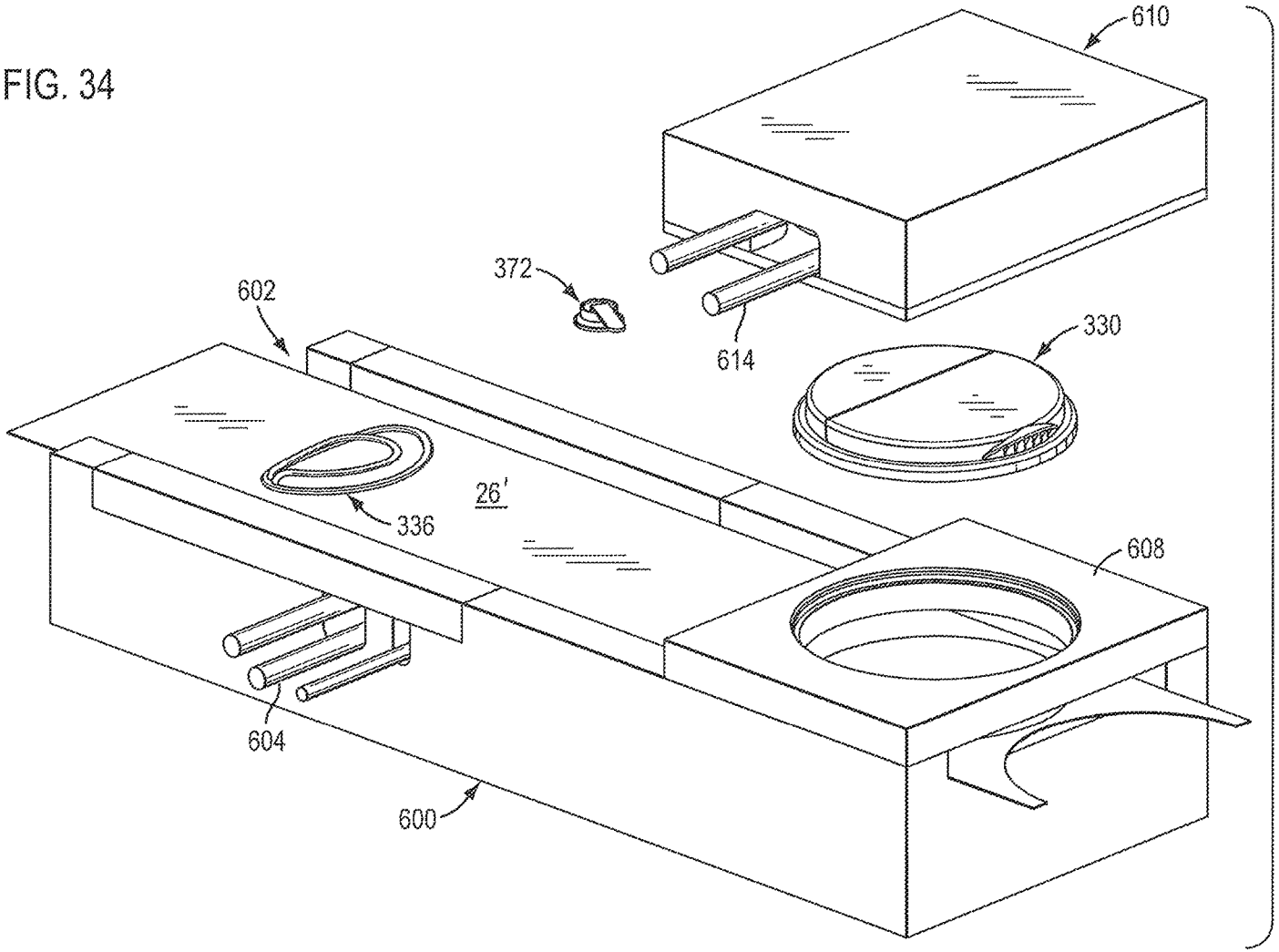
FIG. 34 is a view similar to FIG. 33, but in FIG. 34 the pull ring is placed on the web of membrane material on a thermal bonding machine.
Figure 35:
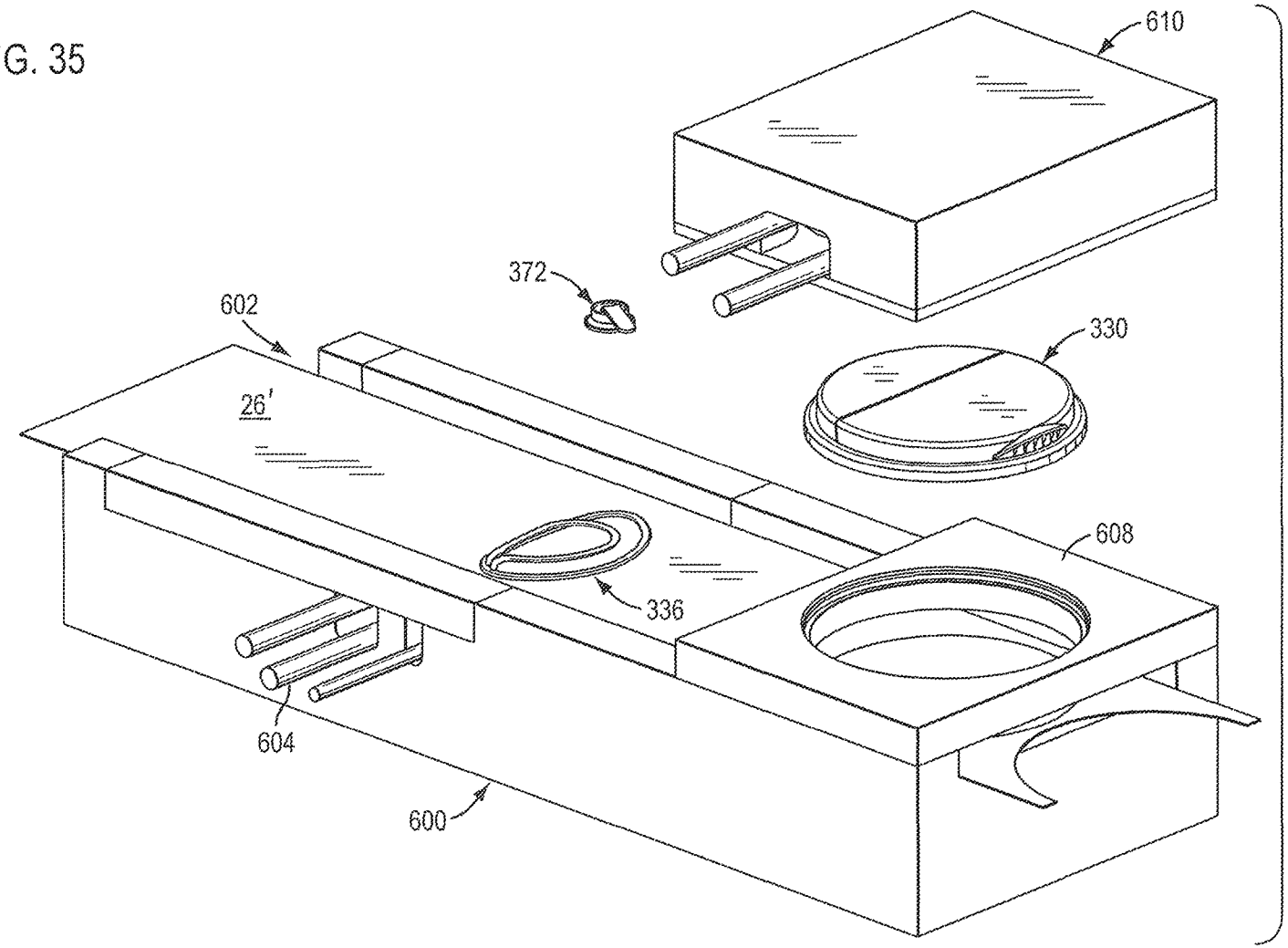
FIG. 35 is a view similar to FIG. 34, but in FIG. 35 the web of membrane material with the pull ring welded thereto is advanced to a next location on the thermal bonding machine.

FIG. 34 illustrates positioning of the pull ring 336 on the membrane web 26' in operative association with the induction coil 604 of welding apparatus 600. When the pull ring 336 is properly positioned on the web 26' relative to the induction coil, activation of the coil effects the thermal bonding of the pull ring 336 to the membrane web. A suitable pressure pad (not shown) or like structure can be provided generally above the welding apparatus 600 for engagement with pull ring 336, to hold the pull ring 336 in the desired contact with membrane web 26' during the induction welding process, whereby the pull ring is thermally bonded to the membrane web.

Figure 36:
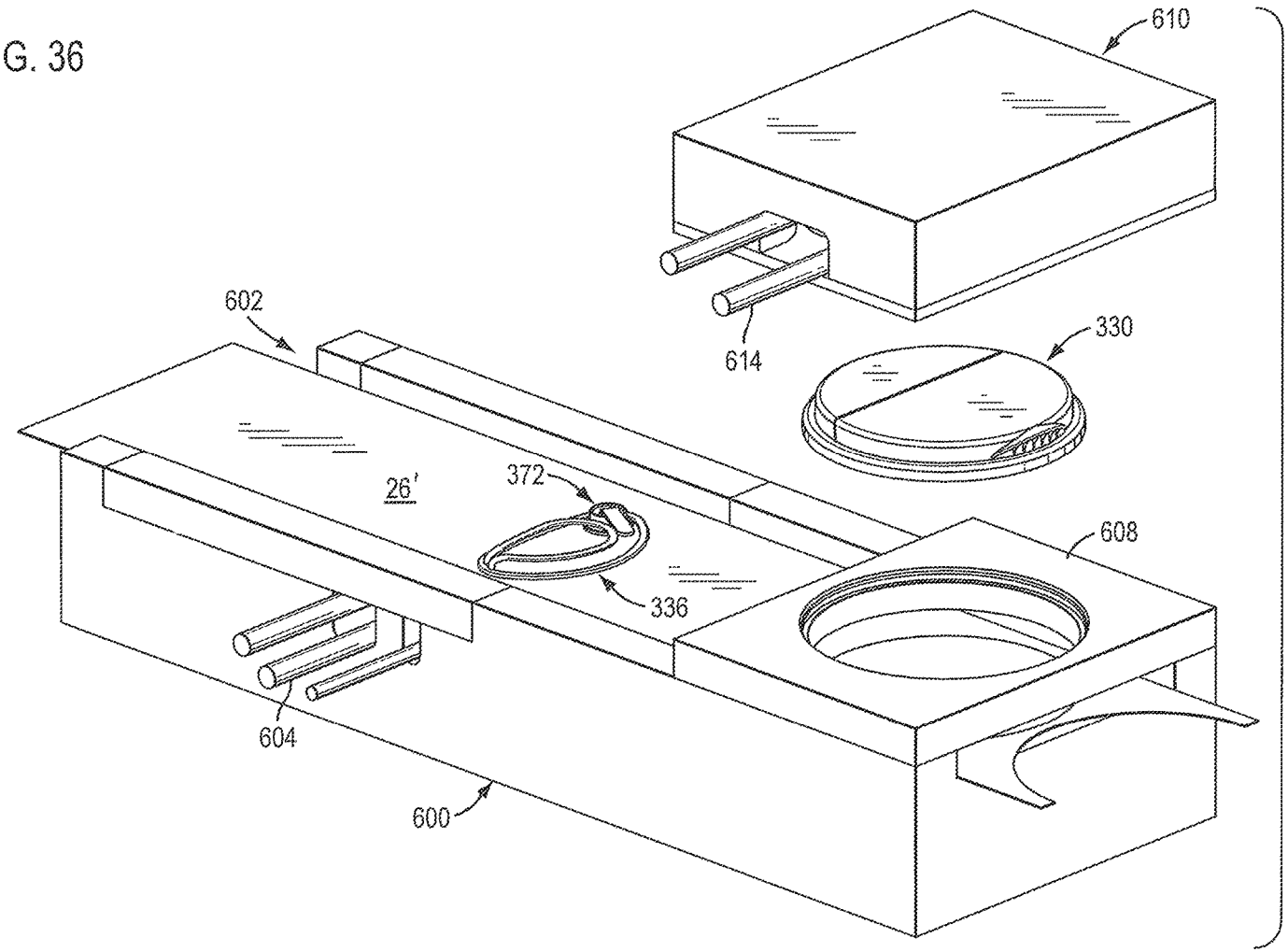
FIG. 36 is a view similar to FIG. 35, but in FIG. 36 the small orifice structure has been placed and thermally bonded to the web of membrane material.

Concurrently with, or subsequent to, bonding of pull ring 336 to membrane web 26', dispensing orifice structure 372 can be similarly thermally bonded to the upwardly facing surface of the membrane web 26'. As illustrated in FIG. 36, dispensing orifice structure 372 is positioned generally within pull ring 336 on the membrane web 26', with activation of induction coil 604 effecting the desired thermal bonding of the dispensing orifice structure 372 to the membrane web 26'.

Figure 37:
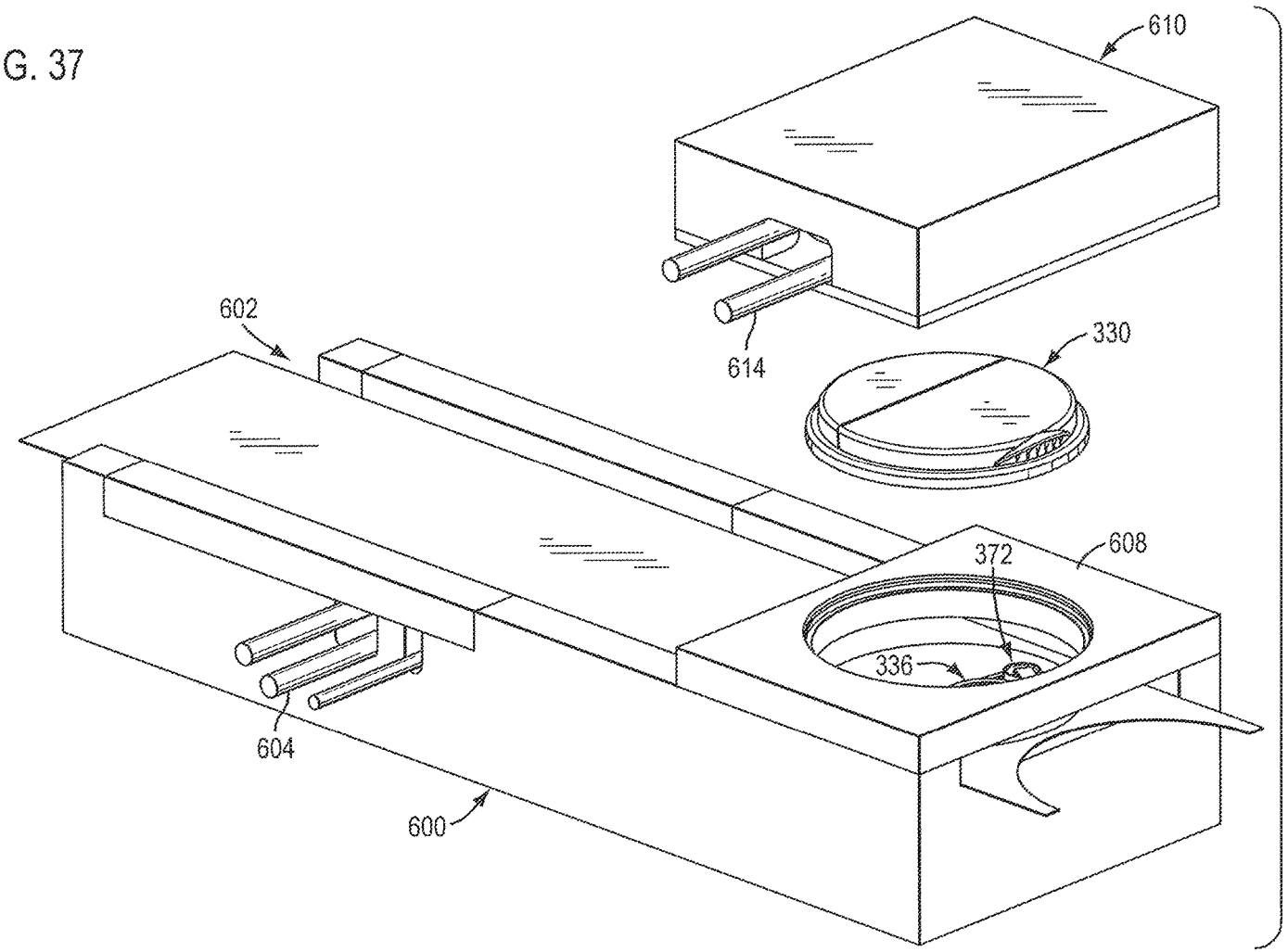
FIG. 37 is a view similar to FIG. 36, but in FIG. 37 the web of membrane material with the pull ring and small dispensing orifice structure welded thereto has been advanced to another position.

Indexed motion of the membrane 26' relative to the welding apparatus 600 advances the web such that the pull ring 336 and dispensing orifice structure 372 are positioned generally beneath, and in operative association with, membrane die cutter 608 as shown in FIG. 37. Notably, die cutter 608 is configured to receive and support the associated closure body 330.

Figure 38:
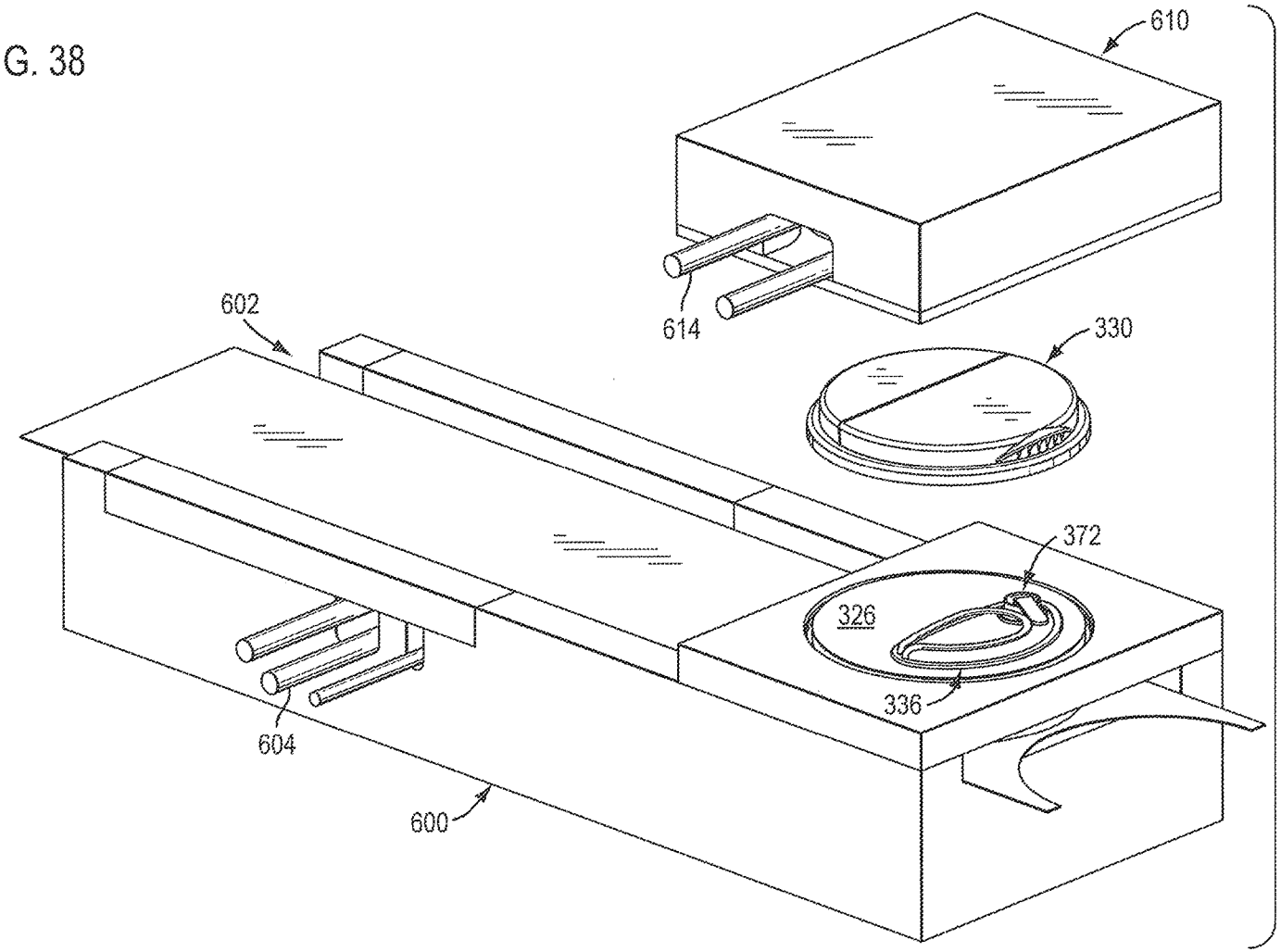
FIG. 38 is a view similar to FIG. 37, but in FIG. 38 the circular disc membrane has been punched from the web of membrane material with the small dispensing orifice structure and pull ring welded thereto, and the circular disc membrane has been elevated with the small dispensing orifice structure and pull ring mounted thereon.

As illustrated diagrammatically in FIG. 38, a membrane punch is actuated so that vertical movement of the punch causes it to cooperate with die cutter 608, thereby cutting the membrane web 26', and severing a discrete membrane 326 from the web. Continued vertical motion of the membrane punch acts to position the now-cut membrane 326, with pull ring 336 and dispensing orifice structure 372 bonded thereto, into position for attachment to the underside of the closure body 330.

Figure 39:
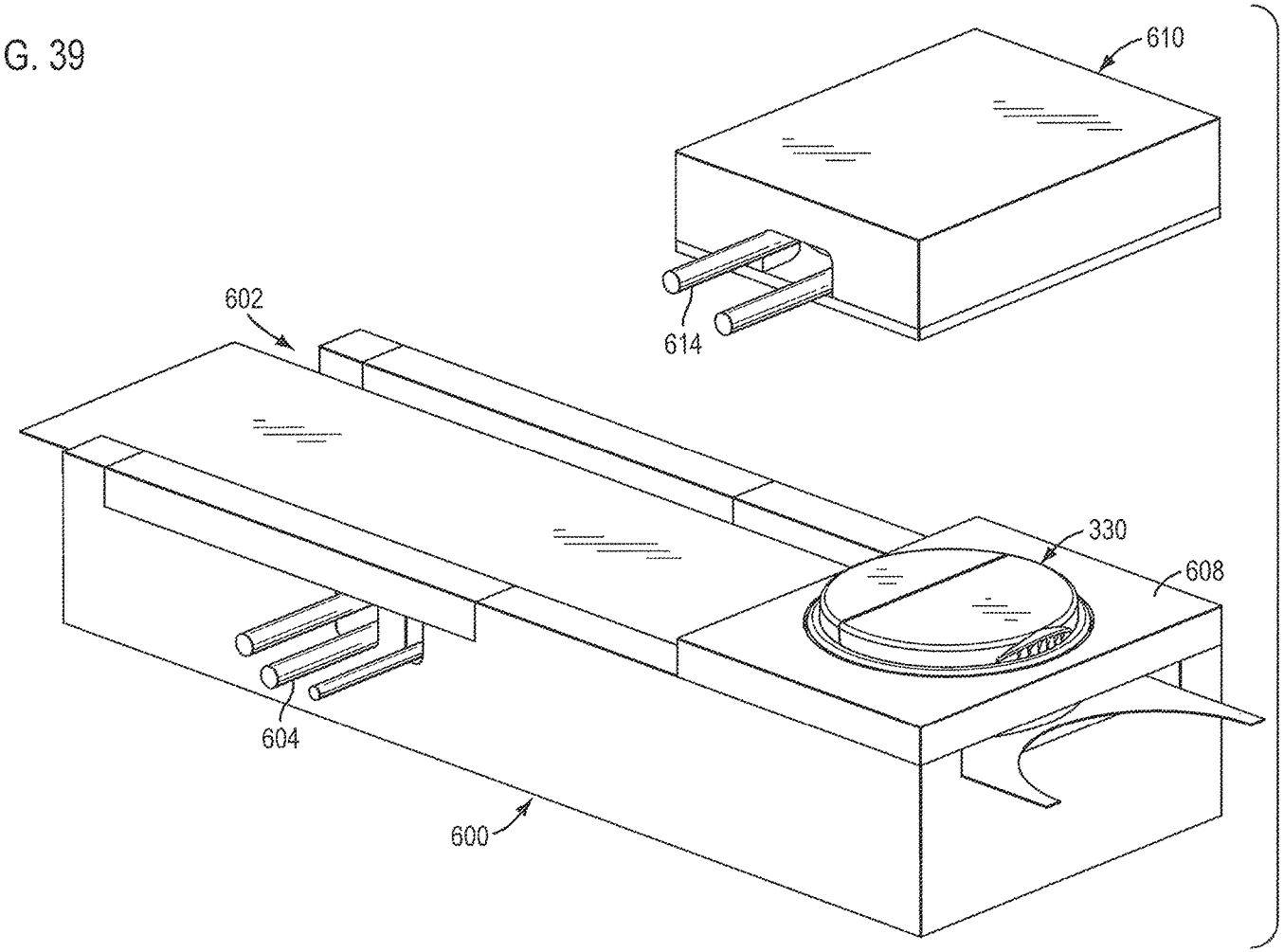
FIG. 39 is a view similar to FIG. 38, but in FIG. 39 the closure body with the closed lid has been lowered onto the nest of the first thermal bonding machine over the circular disc membrane to which is attached the small dispensing orifice structure and pull ring.

As illustrated in FIG. 39, closure body 330 can now be positioned generally on top of membrane die cutter 608 such that membrane 326 is in contact with the downwardly facing surface of the closure body 330.

Figure 40:
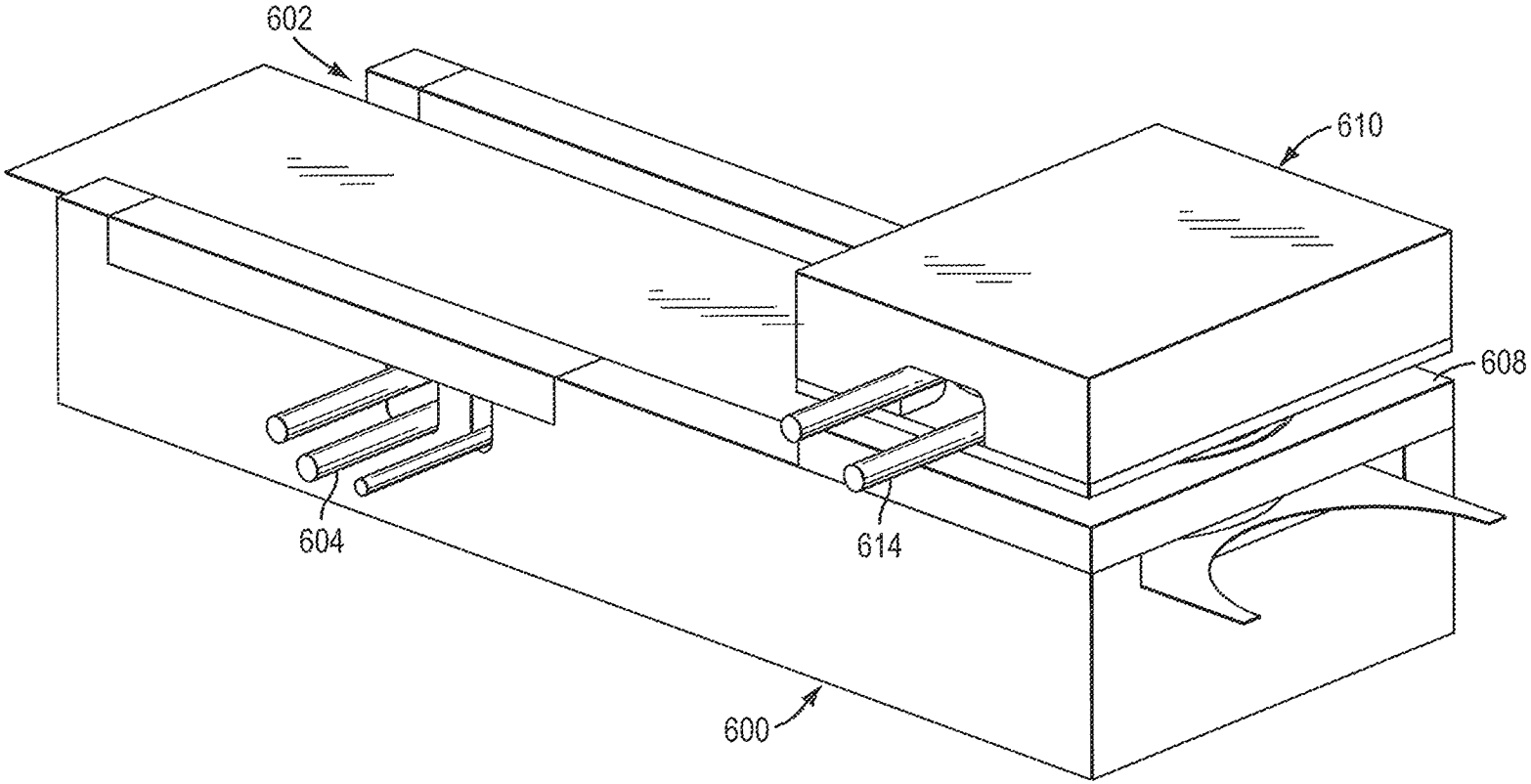
FIG. 40 is a view similar to FIG. 39, but in FIG. 40 the thermal bonding machine weld head is closed to thermally bond the circular membrane to the inside of the closure body.

Formation of the closure 320 is completed by relative movement of the induction welder 610 with respect to the die cutter 608 as shown in FIG. 40, whereby the closure body 330 and membrane 326 are positioned in operative association with the induction welder 612 for attachment of the membrane to the closure body. Activation of an induction coil 614 effects the desired thermal bonding of the membrane to the closure body, whereby formation of the closure 320 is completed. As noted, this embodiment of the present invention includes a dispensing orifice structure 372 attached to the upper surface of the membrane 326 generally within the associated pull ring 336. Relative movement of the induction welder 610 away from membrane die cutter 608 permits the completed closure to be removed from the apparatus 600.

Utensils, such as the utensils 160 and 260 previously described, can also be provided and bonded to the membrane along with the pull ring.

It will be readily observed from the foregoing detailed description of the invention and from the illustrations thereof that numerous other variations and modifications may be effected without departing from the true spirit and scope of the novel concepts or principles of this invention.

What is claimed is:

1. A closure for a container that has an opening to the container interior wherein contents may be stored, said closure comprising:

a closure body for mounting on said container, said closure body defining an opening through said closure body;

a membrane attached to said closure body and extending across at least a portion of said closure body opening; and a pull ring that is separate from said closure body and that is attached to said membrane at said closure body opening whereby a user can pull said pull ring to tear at least a portion of said membrane away from said closure body to provide either access or increased access through said closure body opening; said membrane includes at least one metallic layer and said pull ring is formed from a thermoplastic material that is thermally bonded to said membrane.

2. The closure in accordance with claim 1 in which said membrane is either (A) an imperforate membrane that is free of orifices and initially completely occludes said closure body opening, or (B) defines orifices that are initially occluded by a structure attached to said membrane.

3. The closure in accordance with claim 1 in which at least a portion of each said closure body and membrane each comprises a compatible thermally bondable material; and said membrane is thermally bonded to the underside of at least a portion of said closure body to provide a hermetic seal continuously around the periphery of said closure body opening.

4. The closure accordance with claim 1 in which said closure is in combination with said container;

at least a portion of each said membrane and container each comprises a compatible thermally bondable material;

said container defines an upper end opening permitting communication between the interior of said container and the exterior of said container; and said membrane is thermally bonded to said container to provide a hermetic seal continuously around the periphery of the upper end opening of said container.

5. The closure in accordance with claim 1 in which said membrane has a top surface and a bottom surface; and said closure further includes a utensil attached to either said membrane top surface or said membrane bottom surface.

6. The closure in accordance with claim 1 in which said closure body has a plurality of teeth spaced around said closure body opening so as to contact said membrane.

7. The closure in accordance with claim 1 in which said closure further includes a small dispensing orifice structure attached to said membrane within said pull ring; and said small dispensing orifice structure includes a removable disc initially preventing access under said disc to a portion of said membrane in which at least one orifice is exposed after removal of said disc.

8. The closure in accordance with claim 7 in which said small dispensing orifice structure includes an annular base and an upwardly extending annular wall;

said disc is frangibly connected to said base or wall; and said membrane defines said at least one orifice either both before and after said disc is removed or only after said disc is removed.

9. The closure in accordance with claim 1 in which said pull ring is formed from a first thermoplastic material and is thermally bonded to said membrane, and said closure body is formed from a second thermoplastic material that is different from said first thermoplastic material.

10. A method of making a closure for a container that has an opening to the container interior wherein contents may be stored, comprising the steps of:

providing a closure body for mounting on said container, said closure body defining an opening through said closure body;

providing a membrane;

providing a pull ring that is separate from said closure body;

attaching said membrane to said closure body so that said membrane extends across at least a portion of said closure body opening; and attaching said pull ring to said membrane at said closure body opening, whereby a user can pull said pull ring to tear at least a portion of said membrane away from said closure body to provide either access or increased access through said closure body opening; said membrane includes at least one metallic layer and said pull ring is formed from a thermoplastic material that is thermally bonded to said membrane.

11. The method of making a closure in accordance with claim 10, wherein said step of attaching said membrane to said closure body is performed prior to said step of attaching said pull ring to said membrane.

12. The method of making a closure in accordance with claim 11, wherein said closure includes a lid to be closed over and cover a portion of said closure body, said lid including an internal, resilient spud; and said step of attaching said pull ring to said membrane includes engaging said spud with said pull ring.

13. The method of making a closure in accordance with claim 10, wherein at least a portion of each said membrane and container each comprises a compatible thermally bondable material; and said step of attaching said membrane to said closure body includes thermally bonding said membrane to the underside of at least a portion of said closure body to provide a hermetic seal continuously around the periphery of said closure body opening.

14. The method of making a closure in accordance with claim 10, in which said membrane has a top surface and a bottom surface; and said closure further includes a utensil; and said method includes the step of attaching said utensil to either said membrane top surface or said membrane bottom surface.

15. The method of making a closure in accordance with claim 10, in which said closure further includes a small dispensing orifice structure; and said method includes the step of attaching said small dispensing orifice structure to said membrane within said pull ring.

16. The method of making a closure in accordance with claim 10, in which said step of attaching said pull ring to said membrane is performed prior to said step of attaching said membrane said closure body, and includes the following: attaching said pull ring to a web from which said membrane is formed, and cutting said membrane from said web, with said pull ring attached to the membrane; and said membrane with said pull ring attached thereto is thereafter attached to said closure body so that said membrane extends across at least a portion of said closure body opening.

* * * * *